US011927096B2

(12) United States Patent
Elfar

(10) Patent No.: US 11,927,096 B2
(45) Date of Patent: Mar. 12, 2024

(54) DOWNHOLE AGITATION MOTOR VALVE SYSTEM AND METHOD

(71) Applicant: Talal Elfar, Calgary (CA)

(72) Inventor: Talal Elfar, Calgary (CA)

( * ) Notice: Subject to any disclaimer, the term of this patent is extended or adjusted under 35 U.S.C. 154(b) by 121 days.

(21) Appl. No.: 17/510,926

(22) Filed: Oct. 26, 2021

(65) Prior Publication Data

US 2022/0397004 A1 Dec. 15, 2022

Related U.S. Application Data

(63) Continuation-in-part of application No. 17/343,507, filed on Jun. 9, 2021.

(51) Int. Cl.
*E21B 7/24* (2006.01)
*E21B 21/10* (2006.01)

(52) U.S. Cl.
CPC ..... *E21B 7/24* (2013.01); *E21B 21/10* (2013.01)

(58) Field of Classification Search
CPC ..... E21B 7/24; E21B 21/10
See application file for complete search history.

(56) References Cited

U.S. PATENT DOCUMENTS

| | | | |
|---|---|---|---|
| 8,181,719 | B2 | 5/2012 | Bunney et al. |
| 8,469,104 | B2 | 6/2013 | Downton |
| 9,004,194 | B2 | 4/2015 | Eddison et al. |
| 9,194,208 | B2 | 11/2015 | Schultz et al. |
| 9,273,529 | B2 | 3/2016 | Eddison et al. |
| 9,598,923 | B2 | 3/2017 | Gilleylen et al. |
| 9,637,976 | B2 | 5/2017 | Lorenson et al. |
| 9,702,192 | B2 | 7/2017 | Wicks et al. |
| 9,765,584 | B2 | 9/2017 | Lorenson et al. |
| 9,840,872 | B2 | 12/2017 | Schultz et al. |
| 9,840,873 | B2 | 12/2017 | Schultz et al. |
| 9,903,161 | B2 | 2/2018 | Schultz et al. |
| 9,915,183 | B2 | 3/2018 | Sealy et al. |
| 9,963,937 | B2 | 5/2018 | Prill et al. |
| 10,648,239 | B2 | 5/2020 | Elfar |
| 10,865,612 | B2 | 12/2020 | Elfar |

(Continued)

FOREIGN PATENT DOCUMENTS

| | | |
|---|---|---|
| CA | 2861839 A1 | 7/2013 |
| CA | 2836182 A1 | 6/2014 |

(Continued)

*Primary Examiner* — Dany E Akakpo
(74) *Attorney, Agent, or Firm* — David Guerra

(57) ABSTRACT

A pulsation valve system and method can include a valve mandrel, an oscillating valve and a stationary valve. The valve mandrel can be operably coupled to and downstream of a rotor of a drilling motor. The oscillating valve can be attached to and rotatable with the valve mandrel. The stationary valve can be positioned adjacent and stationary with respect to the oscillating valve head. The stationary valve can include a stationary valve bore defined therethrough. The oscillating valve can include an oscillating valve bore defined therethrough that is alignable with the stationary valve bore at a predetermined rotational position. A valve mandrel cavity allows fluid to travel from the oscillating valve bore and down toward a tool. Rotation of the oscillating valve creates a cyclic obstruction with the stationary valve bore, that results in an agitation force on the drilling motor or bottom hole assembly.

20 Claims, 14 Drawing Sheets

(56) References Cited

U.S. PATENT DOCUMENTS

| | | | | |
|---|---|---|---|---|
| 2007/0187112 | A1 | 8/2007 | Eddison et al. | |
| 2010/0326733 | A1 | 12/2010 | Anderson | |
| 2011/0036560 | A1 | 2/2011 | Vail, III et al. | |
| 2016/0194917 | A1 | 7/2016 | Alali et al. | |
| 2017/0191325 | A1 | 7/2017 | Campbell | |
| 2017/0254182 | A1 | 9/2017 | Gregory et al. | |
| 2018/0038182 | A1 | 2/2018 | Schultz et al. | |
| 2019/0153820 | A1 | 5/2019 | Lorenson et al. | |
| 2021/0277743 | A1 | 9/2021 | Schultz et al. | |
| 2022/0282588 | A1* | 9/2022 | Trinh | E21B 21/10 |

FOREIGN PATENT DOCUMENTS

| | | | |
|---|---|---|---|
| CA | 2892254 | A1 | 7/2014 |
| CA | 2922999 | A1 | 5/2015 |
| CA | 2872736 | C | 12/2015 |
| CA | 2960699 | A1 | 3/2016 |
| CA | 2780236 | C | 7/2016 |
| CA | 2680895 | C | 5/2017 |
| CA | 2892971 | C | 9/2017 |
| CA | 2985258 | A1 | 5/2018 |
| CA | 2798807 | C | 9/2020 |
| CA | 3036840 | C | 4/2021 |
| CA | 3049345 | C | 7/2021 |
| WO | 2017197442 | A1 | 11/2017 |

* cited by examiner

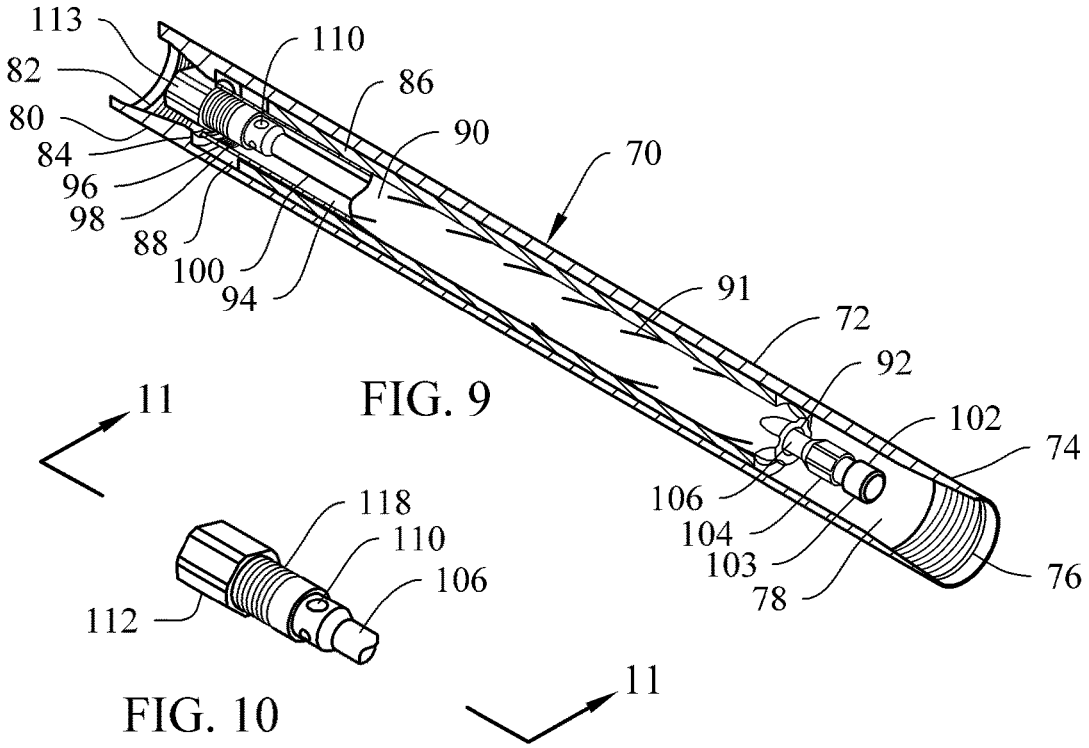
FIG. 9
FIG. 10
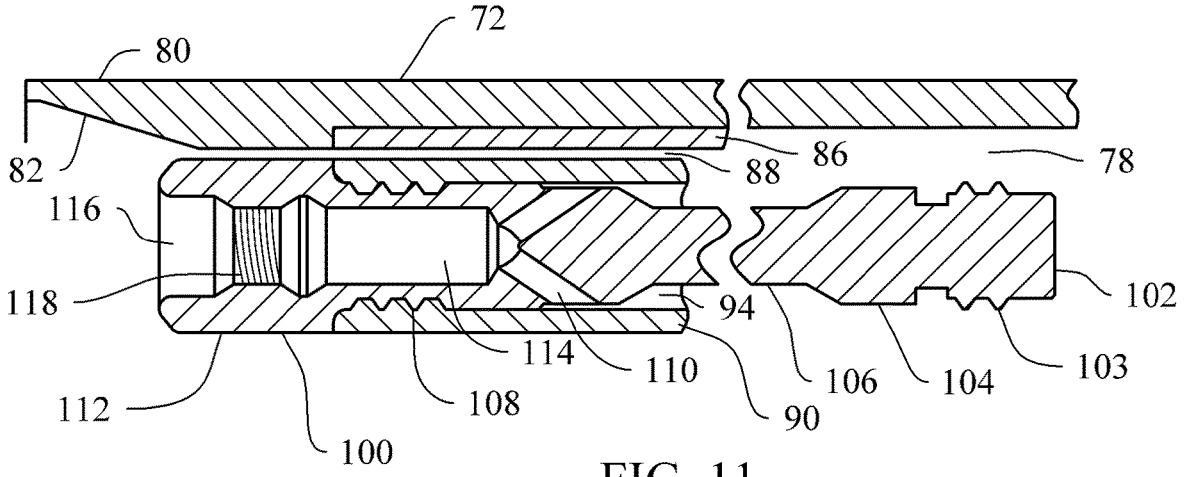
FIG. 11

DOWNHOLE AGITATION MOTOR VALVE SYSTEM AND METHOD

CROSS-REFERENCE TO RELATED APPLICATION

This application is a continuation-in-part under 35 U.S.C. § 120 based upon co-pending U.S. patent application Ser. No. 17/343,507 filed on Jun. 9, 2021, which is incorporated herein by reference in its entirety.

BACKGROUND

Technical Field

The present technology relates to a downhole agitation motor valve system and method for use in connection with providing pulsation and/or agitation within a downhole drilling motor by oscillating fluid flow to the drilling motor for reducing friction acting on a tool string and/or advancing the tool string.

Background Description

Conventional oil and gas drilling involves the rotation of a drill string at the surface which rotates a drill bit mounted to the bottom of the drill string. It is known that to access sub-surface hydrocarbon formations by drilling long bore holes into the earth from the surface. Conventional systems includes advancing a drill bit along the hole, with the drill bit being mounted at the end of a bottom hole assembly (BHA).

During the advancing of the drill bit, friction between the BHA and the well sides can impair the advancing of the drill bit, and in some cases the BHA can get stuck in the well. This is more the case when drilling angled or horizontal holes. In some circumstances, the weight of the drill string is not sufficient to overcome the friction.

In other drilling operations, a motor may be used to rotate the drill bit. Coiled or flexible tubing can be utilized in many downhole operations, but due to its inherent transverse flexibility, coiled tubing in generally more susceptible to buckling than rigid strings consisting of threadably connected tubulars. One solution to this known disadvantage in coiled tubing is to use extended reach tools in conduction with coiled tubing.

Situations occur where it is more difficult to advance the drill bit in a hydrocarbon formation. These situations can occur during horizontal drilling operations wherein additional loads are placed on the coiled tubing. It is common during some operations that friction lock-up occurs and the entire drill string can get stuck in the well.

The use of cavitation devices are known, such as casing reamer shoes, multi-part stators and counter-weighted devices, to create a pulsation or vibration at the BHA to assist in advancement through the earth or to free the BHA. These known cavitation or vibration devices are not capable of providing controlled, tunable pressure pulses, using a stator rotor configuration. Some of these known cavitation or vibration devices are further not capable of being utilized with coiled tubing.

Rotational in combination with stationary valve flow heads may be known in the industry, however, these known valve systems are limited in their operational capacity. They further may have disadvantages of separation between the rotating and stationary valve members due to increase pressure applied between their adjacent surfaces. This can cause the rotating and stationary valve members to separate and allow fluid to freely flow past the valve. A further disadvantage of these known valve can be the direct on and off flow of the fluid, thereby creating increased pressure pulses that can damage the valve and/or tools downstream thereof.

While the above-described devices fulfill their respective, particular objectives and requirements, the aforementioned devices or systems do not describe a downhole agitation motor valve system and method that allows providing oscillating fluid flow to a pulsation and/or agitation device for reducing friction acting on a tool string and/or advancing the tool string.

A need exists for a new and novel downhole agitation motor valve system and method that can be used for providing oscillating fluid flow to a pulsation and/or agitation device for reducing friction acting on a tool string and/or advancing the tool string. In this regard, the present technology substantially fulfills this need. In this respect, the downhole agitation motor valve system and method according to the present technology substantially departs from the conventional concepts and designs of the prior art, and in doing so provides an apparatus primarily developed for the purpose of providing oscillating fluid flow to a pulsation and/or agitation device for reducing friction acting on a tool string and/or advancing the tool string.

SUMMARY

In view of the foregoing disadvantages inherent in the known types of valve system now present in the prior art, the present technology provides a novel downhole agitation motor valve system and method, and overcomes one or more of the mentioned disadvantages and drawbacks of the prior art. As such, the general purpose of the present technology, which will be described subsequently in greater detail, is to provide a new and novel downhole agitation motor valve system and method and method which has all the advantages of the prior art mentioned heretofore and many novel features that result in a downhole agitation motor valve system and method which is not anticipated, rendered obvious, suggested, or even implied by the prior art, either alone or in any combination thereof.

According to one aspect, the present technology can include a pulsation valve system for providing oscillating fluid flow to a downhole tool. The pulsation valve system can include a valve mandrel, an oscillating valve head and a stationary valve head. The valve mandrel can be operably associated with a rotor of a drilling motor assembly for rotation by the rotor. The valve mandrel can include a mandrel cavity defined through a first mandrel end and into the valve mandrel along a longitudinal axis of the valve mandrel. The valve mandrel can include a plurality of lateral bores defined at an angle through the valve mandrel and in communication with the mandrel cavity. The oscillating valve head can be attachable to the valve mandrel and rotatable with the valve mandrel. The oscillating valve head can include an oscillating valve bore defined therethrough and parallel with a longitudinal axis of the oscillating valve head. The oscillating valve head can be attached to the valve mandrel so that the oscillating valve head rotates with the valve mandrel. The stationary valve head can be positioned adjacent and stationary with respect to the oscillating valve head. The stationary valve head can include a stationary valve bore defined therethrough and parallel with a longitudinal axis of the stationary valve head. The oscillating valve bore can be cyclically alignable with the stationary valve bore at a predetermined rotational position based on rotation of the rotor so that the fluid flow cyclically passes through the stationary valve bore and the oscillating valve bore.

According to another aspect, the present technology can include a modular pulsation valve system for providing oscillating fluid flow to a downhole tool. The pulsation valve system can include a valve unit connectable between a power unit and a bearing unit of a drilling motor assembly. The valve unit can include a valve mandrel, an oscillating valve head and a stationary valve head. The valve mandrel can be operably associated with a rotor of a drilling motor assembly for rotation by the rotor. The valve mandrel can include a mandrel cavity defined through a first mandrel end and into the valve mandrel along a longitudinal axis of the valve mandrel. The valve mandrel further can include a plurality of lateral bores defined at an angle through the valve mandrel and in communication with the mandrel cavity. The oscillating valve head can be attachable to the valve mandrel and rotatable with the valve mandrel. The oscillating valve head can include an oscillating valve bore defined therethrough and parallel with a longitudinal axis of the oscillating valve head. The oscillating valve head can be attached to the valve mandrel so that the oscillating valve head rotates with the valve mandrel. The stationary valve head can be positioned adjacent and stationary with respect to the oscillating valve head. The stationary valve head can include a stationary valve bore defined therethrough and parallel with a longitudinal axis of the stationary valve head. The oscillating valve bore can be cyclically alignable with the stationary valve bore at a predetermined rotational position based on rotation of the rotor so that the fluid flow cyclically passes through the stationary valve bore and the oscillating valve bore.

According to yet another aspect, the present technology can include a pulsation valve system including a power unit of a drilling motor assembly, a bearing unit of the drilling motor assembly, and a valve unit attachable therebetween. The power unit can include a rotor configured to rotate upon receiving a fluid flow. The valve unit can include a valve housing, a valve mandrel, an oscillating valve head and a stationary valve head. The valve housing can define a valve housing bore therethrough. The valve mandrel can be rotatably receivable in the valve housing bore. The valve mandrel can be operably associated to the rotor. The valve mandrel can include a central section and a shaft section. The central section can have a size greater than the shaft section thereby creating a stop ledge. A mandrel cavity can be defined in the central section along a longitudinal axis of the valve mandrel, and a plurality of lateral bores can be defined at an angle through the central section and in communication with the mandrel cavity. The oscillating valve head can be attachable to the shaft section adjacent the stop ledge and rotatable within the valve housing bore. The oscillating valve head can be attached to the valve mandrel so that the oscillating valve head rotates with the valve mandrel. The oscillating valve head can include an oscillating valve bore defined therethrough and parallel with a longitudinal axis of the oscillating valve head. The stationary valve head can be attachable to the valve housing in the valve housing bore. The stationary valve head can be positioned adjacent and stationary with respect to the oscillating valve head. The stationary valve head can include a stationary valve bore defined therethrough and parallel with a longitudinal axis of the stationary valve head. The oscillating valve bore can be cyclically alignable with the stationary valve bore at a predetermined rotational position based on rotation of the rotor so that the fluid flow cyclically passes through the stationary valve bore and the oscillating valve bore.

According to still yet another aspect, the present technology can include a method of using a pulsation valve system for providing oscillating fluid flow to a downhole tool. The method can include flowing a working fluid through a power unit of a drilling motor assembly to rotate a rotor. Flowing the working fluid from the power unit to a stationary valve bore defined through a stationary valve head fixedly secured inside a valve assembly housing. Rotating a valve mandrel by way of rotation of the rotor so that an oscillating valve bore defined through an oscillating valve head comes in and out of alignment with the stationary valve bore. The valve mandrel can be operatively coupled to the rotor. Controlling the flow of the working fluid exiting the oscillating valve bore dependent on a rotational location of the oscillating valve bore in relation to the stationary valve bore.

In some or all embodiments, an amount of the fluid flow entering the oscillating valve bore is dependent on a rotational location of the oscillating valve bore in relation with the stationary valve bore.

In some or all embodiments, the stationary valve bore can have a size greater than the oscillating valve bore.

In some or all embodiments, the stationary valve bore can have a radial length greater than a width of the oscillating valve bore.

In some or all embodiments, the stationary valve bore can be offset from a stationary valve central bore defined through the stationary valve head. The stationary valve bore is not in communication with the stationary valve central bore.

In some or all embodiments, the stationary valve head can be fixedly secured in a first section of a valve housing bore of a valve assembly housing. The first section of the valve housing bore can be configured to rotatably receive the oscillating valve head and at least a portion of the valve mandrel.

Some or all embodiments of the present technology can include a bushing located in the stationary valve central bore. The bushing can be configured to rotatably and axially receive a shaft section of the valve mandrel.

In some or all embodiments, the shaft section of the valve mandrel can be receivable and secured in an oscillating valve central bore defined in the oscillating valve head.

In some or all embodiments, the oscillating valve central bore can feature an outwardly tapering section having an entry opening with a size greater than a size of the oscillating valve central bore.

Some or all embodiments of the present technology can include a ring wedge slidably receivable along the shaft section and configured to be received in the tapering section of the oscillating valve central bore.

In some or all embodiments, the valve mandrel can include a central section having a size greater than a size of the shaft section to create a stop ledge. The ring wedge can be configured to abut the stop ledge when the oscillating valve head is attached to the shaft section.

In some or all embodiments, the valve mandrel can include a transitional section between the central section and the shaft section. An exit opening of the lateral bores can be defined in the transitional section, and wherein the stop ledge can be between the transitional section and the shaft section.

In some or all embodiments, the stationary valve head can be secured to the valve housing between the oscillating valve head and a valve housing stop ledge.

In some or all embodiments, the valve housing bore of the valve assembly housing can define a first section having a size greater than a second section thereby creating the valve housing stop ledge.

In some or all embodiments, the oscillating valve head can include channels radially defined in an oscillating valve face of the oscillating valve head adjacent to a stationary valve face of the stationary valve head. The channels can be configured to allow fluid to travel between the stationary valve head and the oscillating valve head to an open area between an internal area of the bushing and an external surface of the shaft section of the valve mandrel.

In some or all embodiments, the oscillating valve head can include external channels defined in an external side of the oscillating valve head that face an internal surface of the valve assembly housing that defines the first section of the valve housing bore. The external channels can be configured to allow fluid to travel between an open area between internal surface of the valve assembly housing and the external side of the oscillating valve head.

Some or all embodiments of the present technology can include a flexshaft connected to a second end section of the valve mandrel. The flexshaft can be operably connected to the rotor of the drilling motor assembly.

In some or all embodiments, the pulsation valve system can be a modular unit configured to be connected between a power unit and a bearing unit of the drilling motor assembly.

In some or all embodiments, the oscillating valve head and/or the stationary valve head can be configured to produce a predetermined number of cyclic obstructions of flow to the downhole tool.

In some or all embodiments, the oscillating valve bore and/or the stationary valve bore can be configured to produce a predetermined flow rate and/or volumetric flow rate.

In some or all embodiments, the stationary valve bore can be a plurality of stationary valve bores radially arrange about a central stationary oscillating valve bore.

In some or all embodiments, the oscillating valve bore can be a plurality of oscillating valve bores radially arrange about a central oscillating valve bore.

In some or all embodiments, a first end of the valve mandrel can be attachable to a connection end of a bearing mandrel of a bearing unit of the drilling motor assembly.

In some or all embodiments, a second end of the valve mandrel can be attachable to a first connection end of a flexshaft, and a second connection end of the flexshaft can be attachable to the rotor.

There has thus been outlined, rather broadly, features of the present technology in order that the detailed description thereof that follows may be better understood and in order that the present contribution to the art may be better appreciated.

Numerous objects, features and advantages of the present technology will be readily apparent to those of ordinary skill in the art upon a reading of the following detailed description of the present technology, but nonetheless illustrative, embodiments of the present technology when taken in conjunction with the accompanying drawings.

As such, those skilled in the art will appreciate that the conception, upon which this disclosure is based, may readily be utilized as a basis for the designing of other structures, methods and systems for carrying out the several purposes of the present technology. It is, therefore, that the claims be regarded as including such equivalent constructions insofar as they do not depart from the spirit and scope of the present technology.

It is another object of the present technology to provide a new and novel downhole agitation motor valve system and method that may be easily and efficiently manufactured and marketed.

An even further object of the present technology is to provide a new and novel downhole agitation motor valve system and method that has a low cost of manufacture with regard to both materials and labor, and which accordingly is then susceptible of low prices of sale to the consuming public, thereby making such downhole agitation motor valve system and method economically available to the buying public.

These together with other objects of the present technology, along with the various features of novelty that characterize the present technology, are pointed out with particularity in the claims annexed to and forming a part of this disclosure. For a better understanding of the present technology, its operating advantages and the specific objects attained by its uses, reference should be made to the accompanying drawings and descriptive matter in which there are illustrated embodiments of the present technology. Whilst multiple objects of the present technology have been identified herein, it will be understood that the claimed present technology is not limited to meeting most or all of the objects identified and that some embodiments of the present technology may meet only one such object or none at all.

BRIEF DESCRIPTION OF THE DRAWINGS

The present technology will be better understood and objects other than those set forth above will become apparent when consideration is given to the following detailed description thereof. Such description makes reference to the annexed drawings wherein:

FIG. 9 is a cross-sectional perspective view of the stator and rotor assembly of the present technology.

FIG. 10 is an enlarged perspective view of the second end of the flexshaft of the present technology.

FIG. 11 is a cross-sectional view of the second end of the flexshaft taken along line 11-11 in FIG. 10.

The same reference numerals refer to the same parts throughout the various figures.

DETAILED DESCRIPTION OF THE EMBODIMENTS

Figure 1:
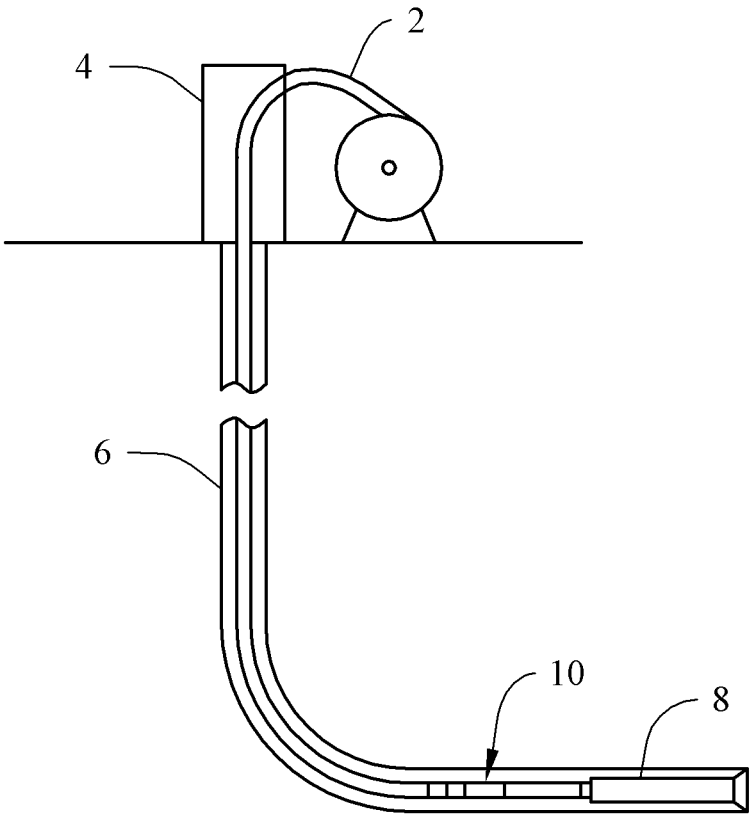
FIG. 1 illustrates a well site system utilizing an embodiment of the downhole pulsation valve system and method constructed in accordance with the principles of the present technology.

In the following description, for purposes of explanation and not limitation, specific details are set forth, such as particular embodiments, procedures, techniques, etc. in order to provide a thorough understanding of the present technology. However, it will be apparent to one skilled in the art that the present technology may be practiced in other embodiments that depart from these specific details.

Referring now to the drawings, and particularly to FIGS. 1-16*b*, an embodiment of the downhole pulsation valve system and method of the present technology is shown and generally designated by the reference numeral 10. The downhole pulsation valve system and method can be utilized for use in connection with providing oscillating fluid flow to a pulsation and/or agitation device for reducing friction acting on a tool string and/or advancing the tool string.

In FIG. 1, a new and novel downhole pulsation valve system and method 10 of the present technology for reducing friction acting on a tool string and/or advancing the tool string by generating and utilizing pressure pulsations is illustrated and will be described. In the exemplary, the downhole pulsation system and method 10 can be utilized with a drill string or coiled tubing 2 that is associated with a bottom hole assembly (BHA) 8 in a wellbore 6. In typical operation, the coiled tubing 2 is run through a well head assembly 4 for insertion into the wellbore 6. It can be appreciated that the present technology can be utilized with jointed drill pipe or other drill string systems. The coiled tubing can provide fluid, hydraulic, electrical or communications to the BHA 8, and also provides a mechanical drive force to advance and retrieve the BHA 8 from the wellbore 6. The BHA 8 can include, but not limited to, a mud motor, a positive displacement motor (PDM), a measurement while drilling (MWD) tool, telemetry systems or other downhole tool assemblies. It can be appreciated that the present technology can be utilized with rigid drill strings.

Some benefits and advantages of the downhole pulsation valve system and method 10 can be that it reduces the friction acting on a tool string, such as the coiled tubing 2, being conveyed through a vertical or non-vertical wellbore 6, by way of the generation of pressure pulsations (vibrations). In doing this, the drill string or coiled tubing 2 can be conveyed or advanced further along the wellbore 6 before friction lock-up occurs.

In the oilfield industry, lock-up is known as a condition that may occur when a coiled tubing string is run into a horizontal (non-vertical) or highly deviated wellbore. Lock-up occurs when the frictional force encountered by the string running on the wellbore tubular reaches a critical point. Although more tubing may be injected into the wellbore, the end of the tool string cannot be moved farther into the wellbore. Helical buckling of the coiled tubing in the wellbore can be disastrous result of a lock-up condition. Coiled tubing, due to its inherent transverse flexibility, is generally more prone to buckling than strings consisting of threadably connected tubulars or jointed pipes.

Figure 2:
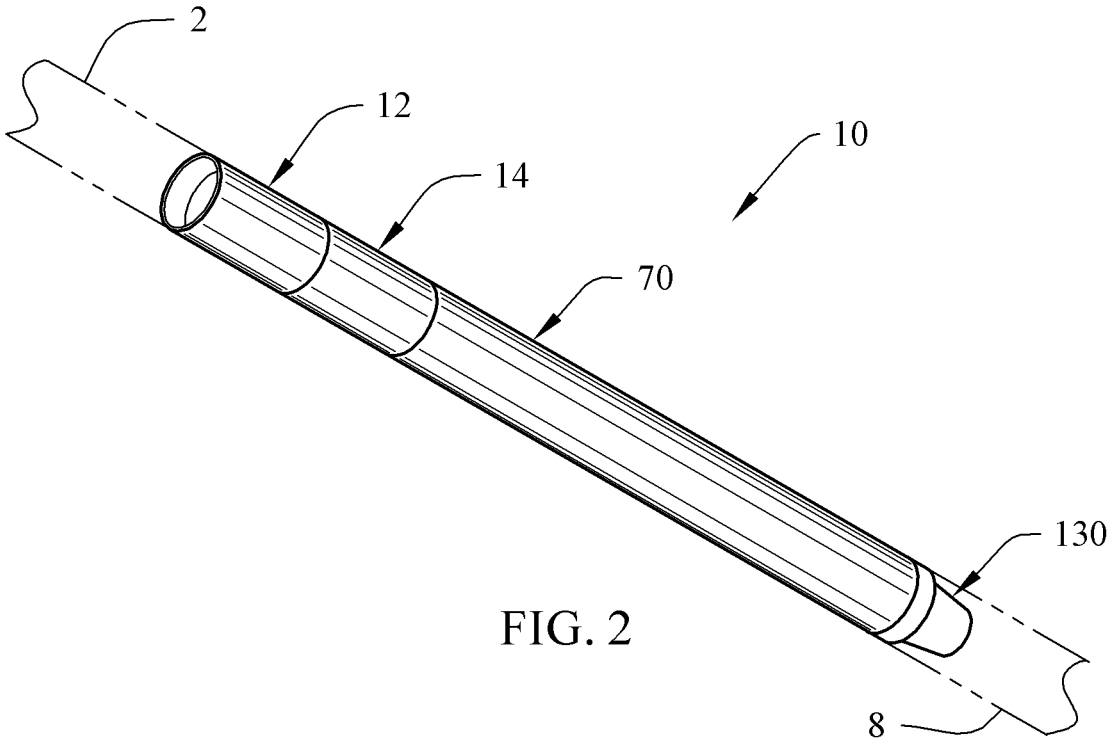
FIG. 2 is a perspective view of an assembled downhole pulsation valve system and method of the present technology.
Figure 3:
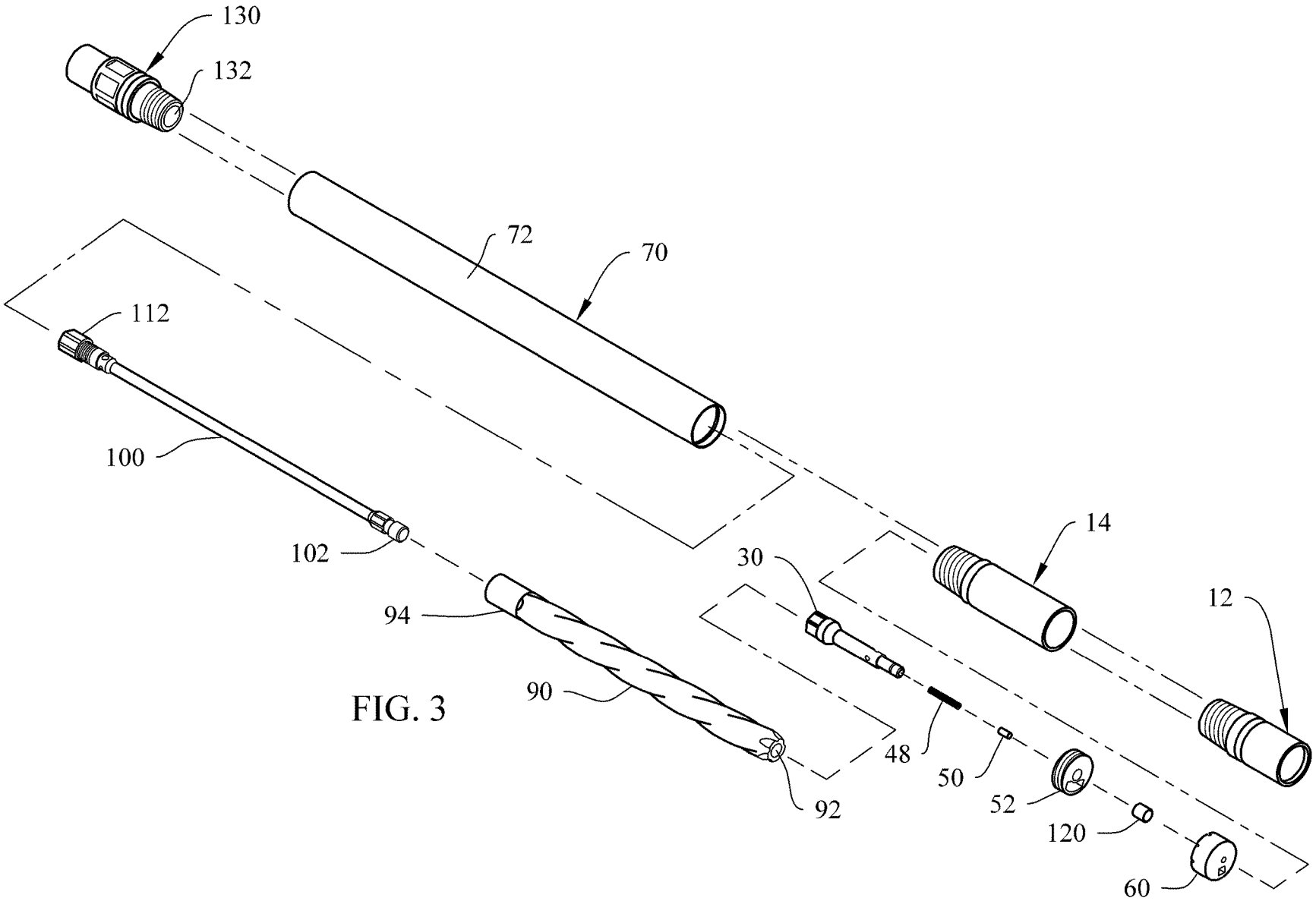
FIG. 3 is an exploded perspective view of the present technology.

Referring to FIGS. 2 and 3, the downhole pulsation valve system and method 10 can include a plurality of assemblies or modules connected together to create a single system that is attachable to the coiled tubing 2 and the BHA 8. The downhole pulsation valve system and method 10 can include a top sub 12, a valve sub assembly 14, an agitator or rotor/stator assembly 70 and a bottom sub 130. The downhole pulsation valve system and method 10, when assembled, can have a smooth outer surface with a diameter less than the wellbore 6, so it can easily be conveyed through the well head assembly 4 and wellbore 6.

Referring to FIGS. 4-8, the valve sub assembly 14 can include a valve assembly housing 16 that can include a bypass mandrel 30, a stationary valve head 52 and an oscillating valve head 60. The valve assembly housing 16 can include a first connection end 18 defining a first end bore 20, and a second connection end 22 defining a second end bore 24 in communication with the first end bore 20. The first connection end 18 can include external or internal coupling means or threading engageable with corresponding coupling means or threading of a second connection end of the top sub 12, so that fluid can be received in the first end bore 20 from an internal bore of the top sub 12.

The second connection end 22 can include external or internal coupling means or threading engageable with corresponding coupling means or threading 76 of a first connection end 74 of the rotor/stator assembly 70.

A width or diameter of the first end bore 20 can be less than a width or diameter of the second end bore 24 to create a ledge or stop edge 26.

The bypass mandrel 30 can include a central body 32, a first end or valve end section 38 and a second end or flexshaft end section 44. A longitudinal mandrel bore 34 is defined through the valve end section 38 and into in the central body 32. The central body 32 can have a first width or diameter. Multiple bypass bores 36 can be radially defined through the central body 32 at an angle and in communication with the mandrel bore 34. The angle of the bypass bores 36 can be from the mandrel bore 34 toward the flexshaft end section 44.

A biasing element or spring 48 can be received in the mandrel bore 34 so that one end thereof contacts an end wall of the mandrel bore 34 or a spring retaining element associated with the mandrel bore 34. A piston 50 can be slidable received in the mandrel bore 34 so that it contacts a second of the spring 48 and blocks or obstructs fluid flow from entering the bypass bores 36 when the piston is in a first position. Fluid flow from the mandrel bore 34 is permitted to flow through the bypass bores 36 when the piston 50 is pushed against the spring 48 in a second position thereby opening the bypass bores 36 to the mandrel bore 34.

The valve end section 38 can have a width or diameter less than the central body 32 thereby creating a stop edge 40. A section of the valve end section 38 near the stop edge 40 can have a smooth exterior surface, while a section near an open end of the valve end section 38 can include an external threaded section 42. The open end of the valve end section 38 defines an opening of the mandrel bore 34.

The flexshaft end section 44 can include exterior planar surfaces, and defining a cavity section 46 that can include internal coupling means or threading. The exterior planar surfaces can be arranged to create a geometrical configuration capable of being engaged with a tool for installation, removal or manipulation of the bypass mandrel 30.

The stationary valve head 52 is receivable and fixable in the second end bore 24 of the valve assembly housing 16, and can include a central bore 53 configured to receive a bushing 120. The central bore 53 can be defined along a longitudinal axis of the stationary valve head 52. A stationary valve bore 54 can be defined through the stationary valve head 52 in a direction parallel with a longitudinal axis of the central bore 53, and can have concentric arcuate or planar edges and parallel sides. With this configuration, the stationary valve bore 54 can have a width measured between its sides that is greater than a width or diameter of the central bore 53. Further in this configuration, the stationary valve bore 54 is offset from the central bore 53 along their parallel longitudinal axes.

Figure 4:
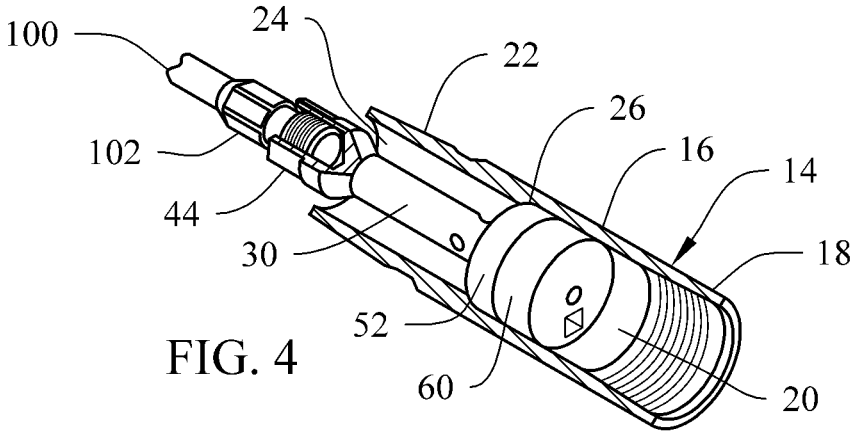
FIG. 4 is a cross-sectional perspective view of the valve assembly of the present technology.
Figure 5:
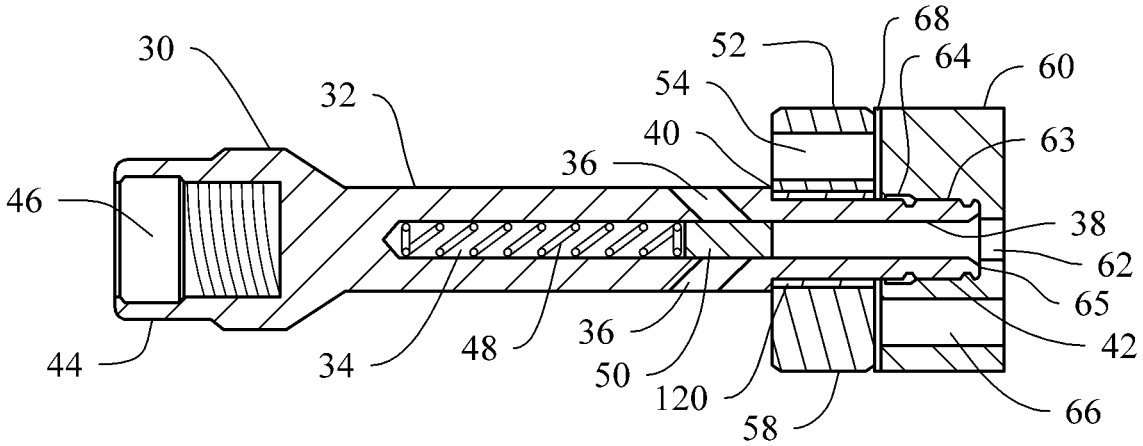
FIG. 5 is a cross-sectional view of the stationary valve head and oscillating valve assembly assembled on the bypass mandrel.
Figure 6:
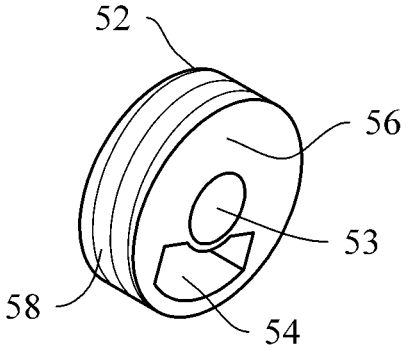
FIG. 6 is a perspective view of the stationary valve head of the present technology.
Figure 7:
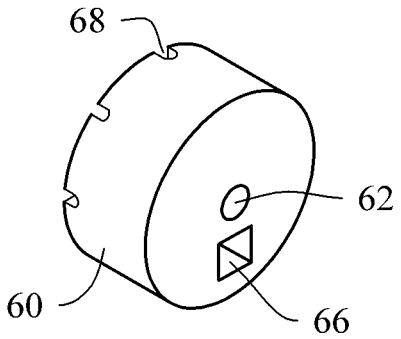
FIG. 7 is a perspective view of the oscillating valve assembly of the present technology.

An exterior surface of the stationary valve head 52 can include coupling means or threading 58 that is configured to engage with coupling means or threading 28 internally located in the second end bore 24 of the valve assembly housing 16. This allows the stationary valve head 52 to be non-rotatably fixed inside the second end bore 24, as best illustrated in FIGS. 4 and 5. In the exemplary, rotating the stationary valve head 52 threadably secures it to the valve assembly housing 16 until contact the stationary valve head 52 contacts the stop edge 26 and securing the stationary valve head 52 in place.

It can be appreciated that the stationary valve head 52 can have a non-cylindrical exterior configuration corresponding to a same non-cylindrical configuration of a receiving section of the second end bore 24, thereby prohibiting the stationary valve head 52 from rotating when received therein.

The oscillating valve head 60 is receivable and rotatable in the second end bore 24 of the valve assembly housing 16, a first bore 62 and a second bore 64 in communication with the first bore 62. The second bore 64 can include coupling means or internal threading 63 configured to engage with the external threading 42 of the valve end section 38 of the bypass mandrel 30.

The first bore 62 can have a width or diameter less than second bore 64 to create a ledge or stop edge 65 that can contact the free end of the valve end section 38 when the oscillating valve head 60 is coupled to the valve end section 38. A length of the second bore 64 to the stop edge 65 can be sufficient to provide a gap between the stop edge 40 of the bypass mandrel 30 and the oscillating valve head 60 that freely receives the stationary valve head 52 therebetween.

An oscillating valve bore 66 is defined through the oscillating valve head 60 parallel with a longitudinal axis thereof. A cross-sectional or lateral profile of the oscillating valve bore 66 can be the same or less than a cross-sectional or lateral profile of the stationary valve bore 54. Alternatively, a radial length of the stationary valve bore 54 can be greater than a width or diameter of the oscillating valve bore 66.

A location of the oscillating valve bore 66 can be offset from the first bore 62 and alignable with the stationary valve bore 54 when the stationary valve head 52 and the oscillating valve head 60 are assembled in the valve assembly housing 16. In this configuration, the oscillating valve bore 66 can be in or out of communication with the stationary valve bore 54 during rotation of the oscillating valve head 60 in relation with the stationary valve head 52.

It can be appreciated that the oscillating valve bore 66 can have a size smaller than that of the stationary valve bore 54, thereby allowing the oscillating valve bore 66 to be in communication with the stationary valve bore 54 at predetermined radial positions. The amount of time the oscillating valve bore 66 and the stationary valve bore 54 are in communication with each other can be dependent on the size of the oscillating valve bore 66, the size of the stationary valve bore 54, the number of oscillating valve bores 66 and/or stationary valve bores 54, and/or the rotational speed of the oscillating valve bores 66.

Grooves or slots can be defined in an internal surface defining the first end bore 20 of the valve assembly housing 16, and configured to retaining fluid on an outside of the oscillating valve head 60 thereby creating a hydrodynamic bearing between the perimeter of the oscillating valve head 60 and internal surface defining the second end bore 24.

An end side of the oscillating valve head 60 that faces the stop edge 40 when assembled can include a plurality of channels 68. The channels 68 can be radially defined in communication with an exterior of the oscillating valve head 60 and the second bore 64. It can be appreciated that the channels 68 can be further defined radially in communication with an exterior of the stationary valve head 52 and the second bore 64 so that the channels of the stationary and oscillating valve heads 52, 60 face each other. These channels 68 can be configured to allow fluid to flow between adjacent surfaces of the stationary valve head 52 and the oscillating valve head 60 allowing for lubrication therebetween, as well as a contact area 122 between the bushing 120 and the valve end section 38 of the bypass mandrel 30.

The bushing 120 can be received in the central bore 53 and can be configured for receiving the smooth exterior surface portion of the valve end section 38. The bushing 120 can allow for smooth and free rotation of the valve end section 38 of the bypass mandrel 30 within the central bore 53 of the stationary valve head 52. Further, the bushing 120 can be easily replaced if significant wear or damage is detected on the bushing 120. It can be appreciated that the bushing 120 can be a sacrificial part as compared to the bypass mandrel 30 and/or the stationary valve head 52, and can be made of any suitable material.

When assembled, it can be appreciated that the valve end section 38 is insertable through the bushing 120 and as such the central bore 53 of the stationary valve head 52. The oscillating valve head 60 is secured to the valve end section 38 so that the stationary valve head 52 freely positioned between the stop edge 40 and the end side of the oscillating valve head 60 including the channels 68. The stop edge 40 can be configured to prevent the bypass mandrel 30 from sliding out of place and/or to keep the bushing 120 within the central bore 53.

Referring to FIGS. 9-11, the rotor/stator assembly 70 includes a stator housing 72, a stator 86, and a rotor 90. The rotor/stator assembly 70 can be configured to be a progressing-cavity rotor/stator combination provides rotational power to turn the rotor relative to the stator. The stator housing 72, as best illustrated in FIG. 9, defines an axial cavity or stator housing bore 78 therethrough, and includes a first connection end 74 featuring coupling means or threading 76 capable of being engageable with the corresponding coupling means or threading of the second connection end 22 of the valve assembly housing 16, thereby stator housing 72 and the valve assembly housing 16. It can be appreciated that seals can be utilized between the first connection end 74 of the stator housing 72 and the second connection end 22.

It can further be appreciated that different valve subassemblies 14 can utilized thereby making the valve sub assembly 14 a module component in the overall aspect of the present technology. Further, the valve assembly housing 16 may be integrally formed with the stator housing 72, thereby creating a combined valve and rotor/stator assembly unit.

A second connection end 80 of the stator housing 72, as best illustrated in FIGS. 9 and 11 can feature coupling means or threading 82. Further, the stator housing bore 78 can have a width or diameter greater than a width or diameter of a through bore defined in the second connection end 80, thereby creating a ledge or stop edge 84.

The stator 86 can be received in the stator housing bore 78 of the stator housing 72 and fittingly secured thereto, so that the stator 86 and stator housing 72 is substantially a single unit. The stator 86 can be a tubular extension defining an axial cavity or stator bore 88 therethrough, and extending in the longitudinal direction of the stator housing 72. The stator bore 88 is in communication with the stator housing bore 78, so as to receive fluid from the valve assembly housing 16. The stator 86 can include multiple lobes extending into the stator bore 88 or can have a smooth internal surface.

The rotor 90 includes a first end 92, a longitudinal bore 94 defined therethrough, and a second connection end 96. The first end 92 can be an open free end, and the second connection end 96 can include internal coupling means or threading 98.

As best illustrated in FIG. 9, the rotor 90 can include exterior planar surfaces that can be part of or adjacent the first end 92 and/or the second connection end 96. The external planar surfaces can be arranged to create a geometrical configuration capable of being engaged with a tool for installation, removal or manipulation of the rotor 90. One or more helical or spiral lobes 91 are configured along a part of a longitudinal length of the rotor 90.

Figure 12:
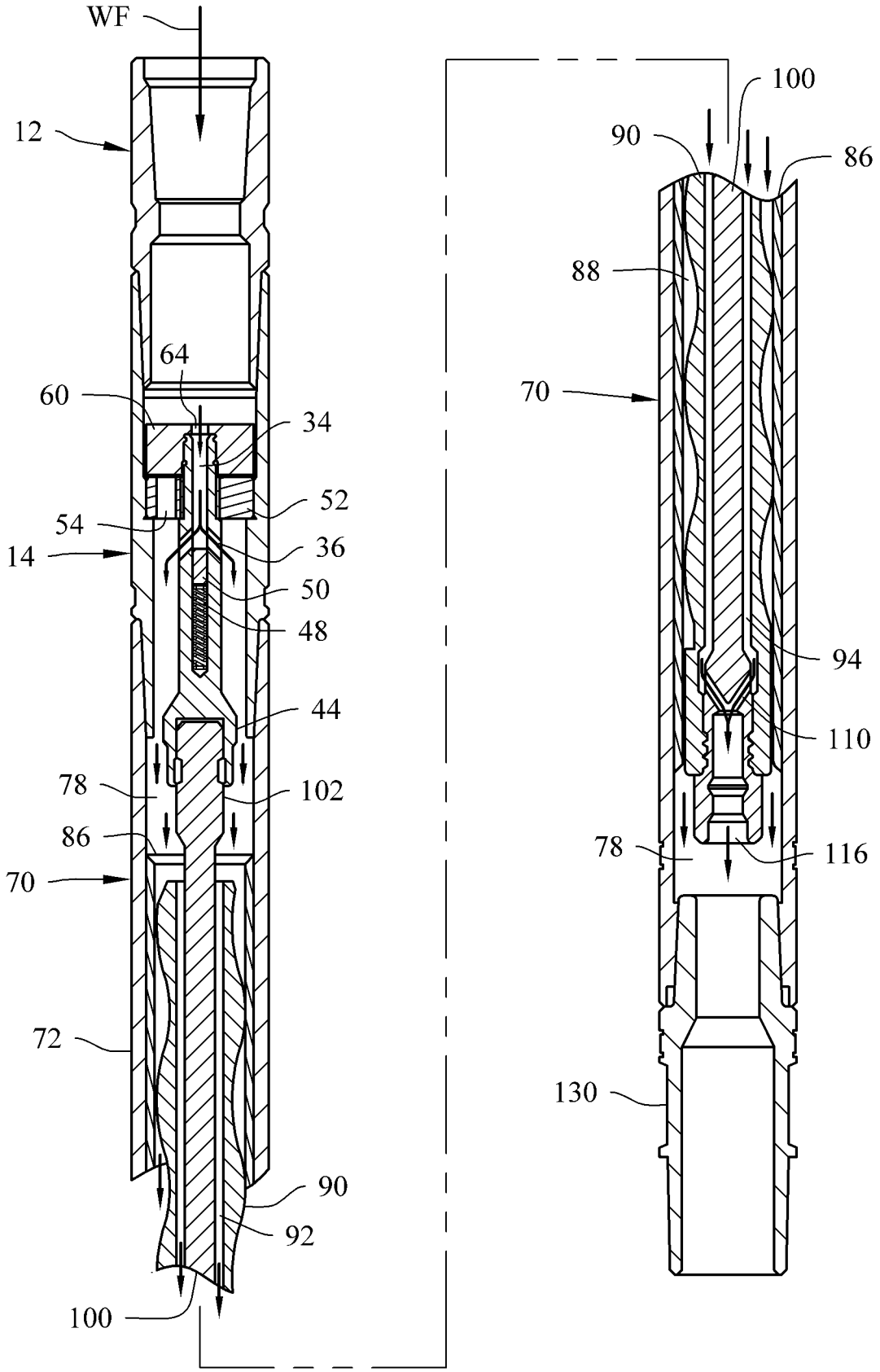
FIG. 12 is a cross-sectional view of the assembled downhole pulsation valve system and method of the present technology with the oscillating valve assembly in a closed position or when first encountering the pumped fluid.
Figure 13:
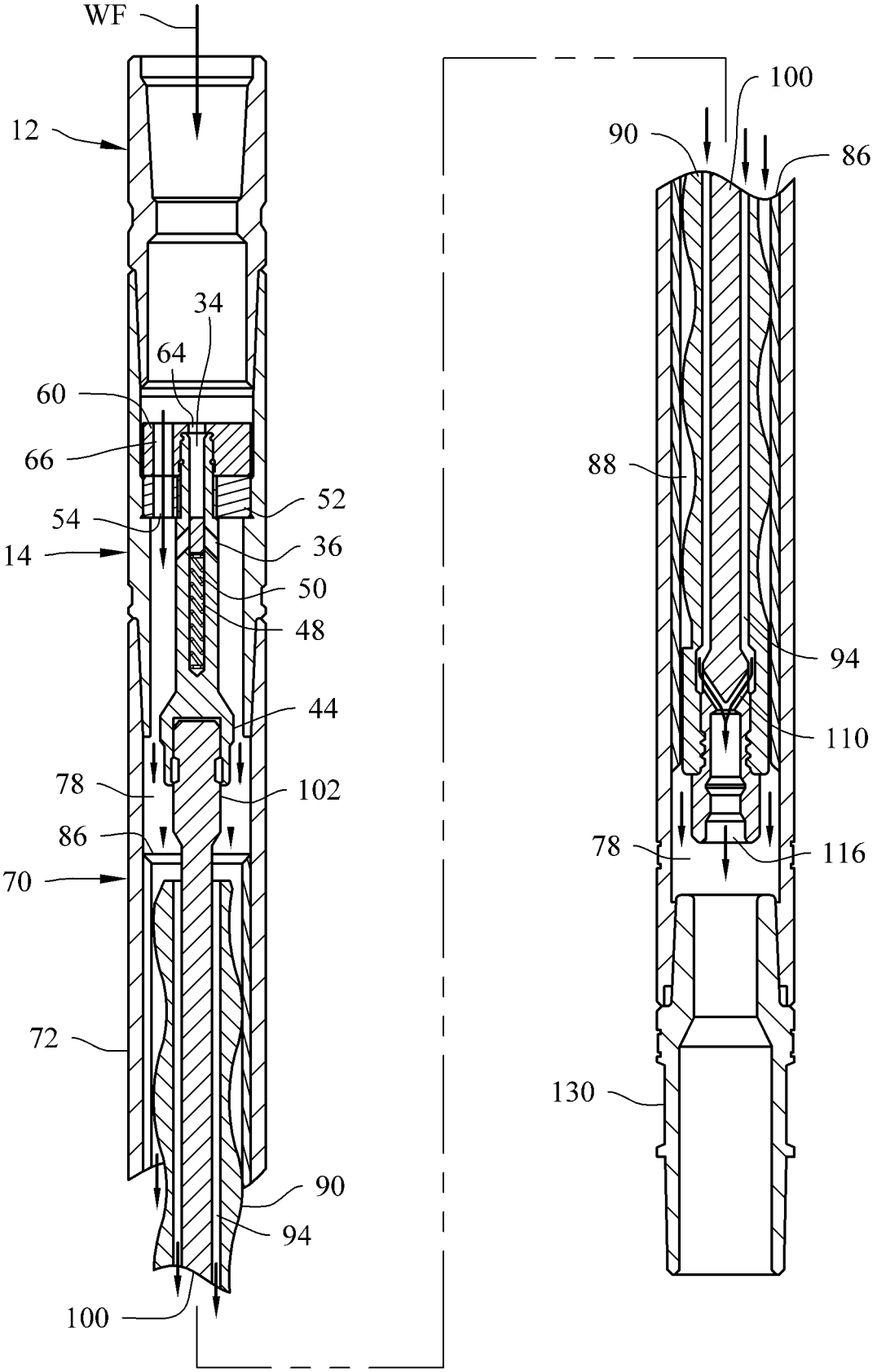
FIG. 13 is a cross-sectional view of the assembled downhole pulsation valve system and method of the present technology with the oscillating valve assembly in an opened or partially opened position resulting from rotation by the rotor/stator assembly.

The rotor 90 is slidably and rotatably received in the stator bore 88, with lobes or internal surface of the stator 86 and the lobes 91 or the rotor 90 being complimentary to or with each other. The complimentary configuration of the lobes is capable of rotation of the rotor 90 relative to the stator 86 responsive to a flow of fluid traveling through stator bore 88, as best illustrated in FIGS. 12-13.

A driveshaft or flexshaft 100, as best illustrated in FIGS. 10-11, can include a first connection end 102 featuring external coupling means or threading 103, a first set of exterior planar surfaces 104 part of or adjacent with the first connection end 102, a shaft section 106, a second set of external planar surfaces 113, and a second connection end 112 featuring external coupling means or threading 108. The second set of external planar surfaces 113 can be part of or adjacent with the second connection end 112.

The flexshaft 100 is receivable in the longitudinal bore 94 of the rotor 90, and is configured to create an annulus between the flexshaft 100 and the longitudinal bore 94, thereby allowing fluid from the stator housing bore 78 to travel therethrough pass the flexshaft 100.

The external threading 103 of the first connection end 102 is capable of being engageable with the internal threading of the cavity section 46 of the flexshaft end section 44 of the bypass mandrel 30, thereby joining the flexshaft 100 and the bypass mandrel 30. It can be appreciated that seals can be utilized between the first connection end 102 of the rotor 90 and the cavity section 46 of the flexshaft end section 44 of the bypass mandrel 30.

The threading 108 of the second connection end 112 can be configured to engage with the internal threading 98 of the second connection end 96 of the rotor 90, thereby securing the rotor 90 with the flexshaft 100. It can be appreciated that any rotation and/or oscillation of the rotor 90 produced fluid flow through the stator bore 88 and about the lobes 91 would be conveyed to the flexshaft 100 and accordingly to the bypass mandrel 30 and the oscillating valve head 60 attachable thereto.

Adjacent to the second connection end 112 between the threading 108 and the shaft section 106 can be defined a plurality of ports 110. The ports 110 can be angled or tapered toward each other from a direction of the shaft section 106 toward the second connection end 112.

A second end cavity 114 can be defined in the second connection end 112 that is in communication with an open end 116 of the second connection end 112. Consequently, fluid flowing through the longitudinal bore 94 of the rotor 90 would enter the ports 110 and then travel into the second end cavity 114 and out the open end 116 for use downstream thereof.

It can be appreciated that the second end cavity 114 or the open end 116 can include internal coupling means or threading 118 for engagement with complimentary coupling means of a downhole tool or component, a drill string or conduit, or any other downhole element.

A plug or a restricting orificed plug (not shown) can be received in the open end 116 and secured therein by the threading 118. This plug can prevent flow from bypassing the flexshaft 100.

It can be appreciated that seals can be utilized between any element attached with the second connection end 112, the open end 116 and/or the second end cavity 114.

The first and second set of external planar surfaces 104, 113 can be arranged to create a geometrical configuration capable of being engaged with a tool for installation, removal or manipulation of the flexshaft 100.

The flexshaft 100 is configured or capable of undergoing nutation as well as rotation, this can be accomplished with the flexshaft 100 having sufficient transverse flexibility. The shaft section 106 can have a diameter less than the first and second ends or sufficient enough to provide the transverse flexibility required of the present technology.

The bottom sub 130 defines an axial bottom sub bore or cavity 132 therethrough, and includes a first connection end featuring external coupling means or threading capable of being engageable with the internal threading 82 of the second connection end 80 of the stator housing 72, thereby joining the stator housing 72 and the bottom sub 130. It can be appreciated that seals can be utilized between the first connection end of the bottom sub 130 and the second connection end 80 of the stator housing 72.

The bottom sub 130 can include a pin connection end capable of coupling with the BHA 8 or a drill motor top sub. It can be appreciated that seals can be utilized between a first connection end of the bottom sub 130 and the second connection end 80 of the stator housing 72.

In use, it can now be understood that pressurized fluid flowing through the progressing-cavity of the rotor/stator assembly 70 provides rotational power to turn the rotor 90 relative to the stator. It can be appreciated that the stator 86 can be rigidly connected to the BHA 8, either directly or by way of the stator housing 72.

Referring to FIGS. 12-13 and in the exemplary, the downhole pulsation valve system and method 10 can be assembled with the valve assembly housing 16 connected in series to the drill string 2 either directly or via the top sub 12, and the stator housing 72. The stator housing 72 can then be connected to the BHA 8 either directly or via the bottom sub 130. The drill string 2, downhole pulsation valve system 10 and the BHA 8 can be introduced and advanced through the wellbore 6 for downhole operations.

Prior to attaching the valve assembly housing 16 to the drill string 2 or the top sub 12, the stationary valve head 52 is secured inside the first end bore 20 of the valve assembly housing 16 via the coupling means or threading 28, 58. After which, the valve end section 38 of the bypass mandrel 30 can be inserted through the central bore 53 of the stationary valve head 52. Then, the first bore 62 of the oscillating valve head 60 can be positioned to receive the valve end section 38 and secured together via the coupling means or threading 42, 63. In this assembled configuration, the bypass mandrel 30 and the oscillating valve head 60 are rotatable within the first and second end bores 20, 24 and in relation to the stationary valve head 52.

Working fluid WF is pumped through the drill string or coiled tubing 2, which enters the valve sub assembly 14.

It can be appreciated that the stationary and oscillating valve heads 52, 60 can be in a closed position, a partially open position and/or a fully open position depending on rotation of the oscillating valve head 60. In the closed position, the oscillating valve bore 66 is not in communication with the stationary valve bore 54. In the partially open position, the oscillating valve bore 66 is in communication or in partial communication with the stationary valve bore 54 of the stationary valve head 52. In the fully open position, the oscillating valve bore 66 is in full communication with the stationary valve bore 54.

Figure 8:
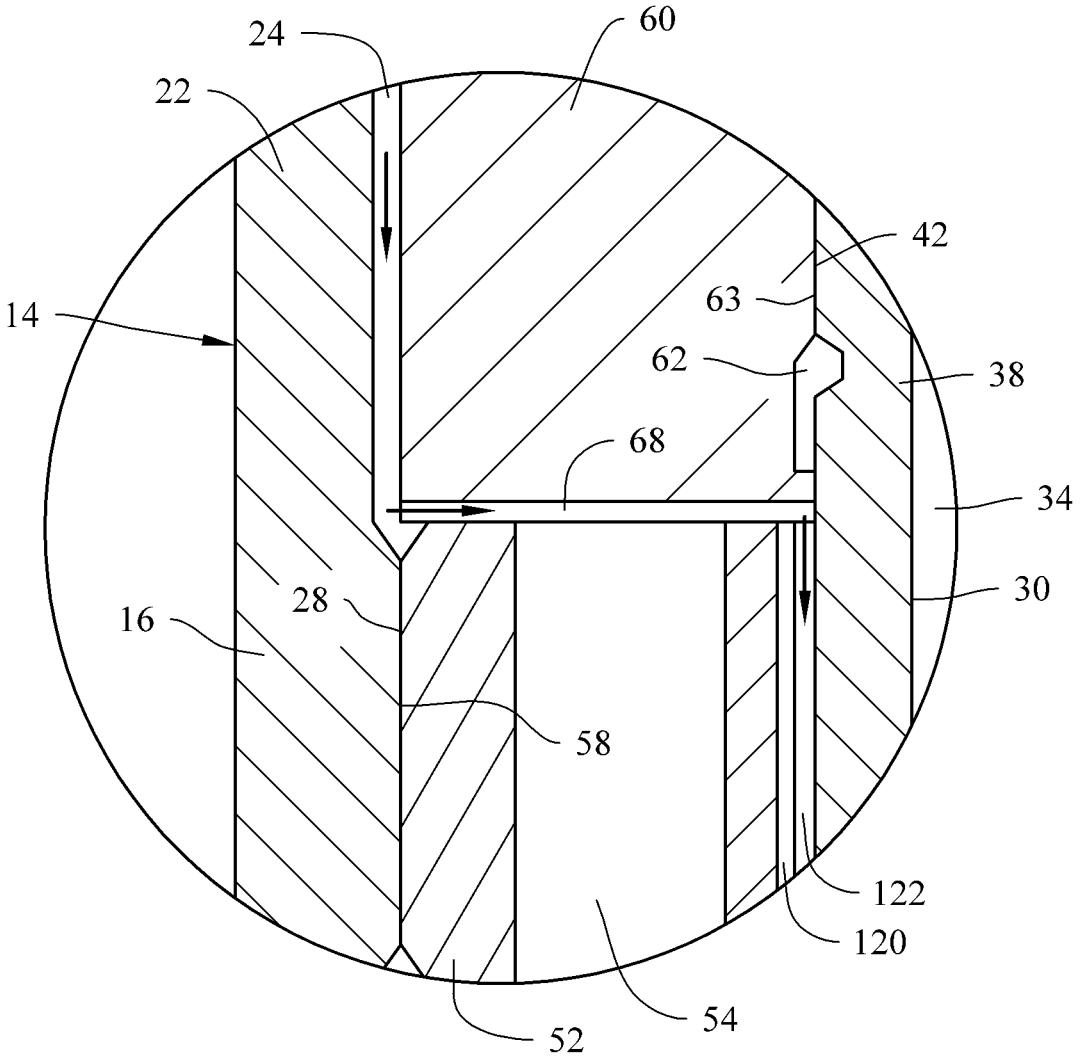
FIG. 8 is an enlarged cross-sectional view of the hydrodynamic bearing associated with the stationary valve head and the oscillating valve assembly.

If the stationary and oscillating valve heads 52, 60 are in the closed position, and when first encountering the pumped working fluid WF, then the flow is diverted radially outwards on the face of the oscillating valve head 60 and pushed in between the outside of the oscillating valve head 60 and the inside of the valve assembly housing 16 defining the first end bore 20. This flow is retained on the outside of the oscillating valve head 60 via grooves or slots defined in an internal surface defining the first end bore 20, creating a hydrodynamic bearing in between the perimeter of the oscillating valve head 60 and the wall of the valve assembly housing 16, as best illustrated in FIGS. 8 and 12. The fluid can then flow into the channels 68 extended radially from a center to outside, on the face of one or both of the stationary and oscillating valve heads 52, 60. This fluid flow allows for lubrication of the face-to-face contact between the stationary and oscillating valve heads 52, 60, as well as the contact between the bushing 120 and the bypass mandrel 30.

Further in this closed position, fluid pressure from the working fluid WF is higher than when in the partially or fully open position. This increased pressure provides fluid flow can be diverted into the first bore 62 on the face of the oscillating valve head 60 and into the inside of the mandrel bore 34 of the bypass mandrel 30, thereby pushing on the piston 50 slidably nested within mandrel bore 34.

The fluid flow pushing on the piston 50 results in the piston 50 being pushed against the spring 48 and away from the bypass bores 36 thereby allowing the fluid flow to exit the mandrel bore 34 through the bypass bores 36 and into the second end bore 24 of the valve assembly housing 16. The spring 48 can be designed to collapse at a predetermined pressure that is higher than pressures encountered during a water hammer phenomenon, consequently allowing fluid flow to be diverted past the valve sub assembly 14 and into the power section of the rotor/stator assembly 70. This allows for start-up rotation of the rotor 90 and consequently the bypass mandrel 30 and the oscillating valve head 60 by way of the flexshaft 100.

This startup rotation or continued rotation of the rotor 90 can be provided in that the working fluid travels through rotor/stator assembly 70. Upon which, nutation and rotation is imparted onto the rotor 90, which consequently rotates the flexshaft 100 that consequently rotates the bypass mandrel 30 that rotates the oscillating valve head 60 between the closed, partially opened and fully opened positions, as best illustrated in FIG. 13.

It can be appreciated that during rotation of the rotor 90, rotation of the oscillating valve head 60 is made concentric through use of the nested flexshaft 100, housed within the longitudinal bore 94 of the rotor 90, in combination with the bushing 120 placed inside of the central bore 53 of the stationary valve head 52. The bushing 120 can be retained by the stop edge 40 or by a lip on the downstream face of the stationary valve head 52.

The flexshaft 100, mated to the bypass mandrel 30 on an upstream side of the rotor 90, can take the primary loading to the transfer of eccentric rotation of the rotor 90 to concentric rotation at the bypass mandrel 30.

As the oscillating valve head 60 rotates, it encounters periods of flow going into the oscillating valve bore 66 and periods of blocked flow based on the mating design between the stationary valve bore 54 of the stationary valve head 52 and the oscillating valve bore 66 of the oscillating valve head 60. Accordingly creating a water hammer phenomenon within the tubing and BHA 8.

An axial travel of the power section of the rotor/stator assembly 70 can be limited by the stop edge 40 of the bypass mandrel 30 on the downstream side of the stationary valve head 52, and the face of the oscillating valve head 60 on the upstream side of the stationary valve head 52.

The flexshaft 100 can have an optional bypass plug on the downstream side of the rotor 90, allowing for adjustable rotor speeds at a specified flow rate.

Flow exiting the rotor/stator assembly 70 can pass through the bottom sub 130 and continue downstream to the BHA 8.

Figure 14A:
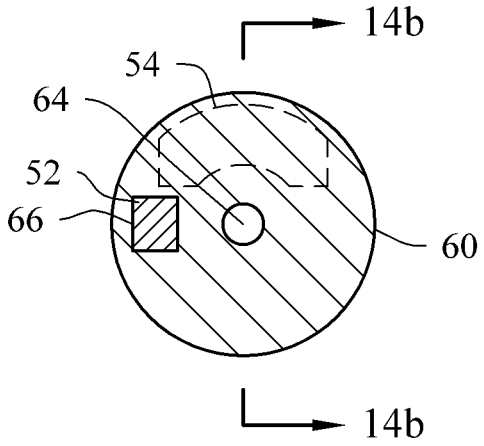
FIGS. 14*a* and 14*b* are cross-sectional views of the oscillating valve assembly in a closed position, with FIG. 14*b* taken along line 14*b*-14*b* in FIG. 14*a*.
Figure 14B:
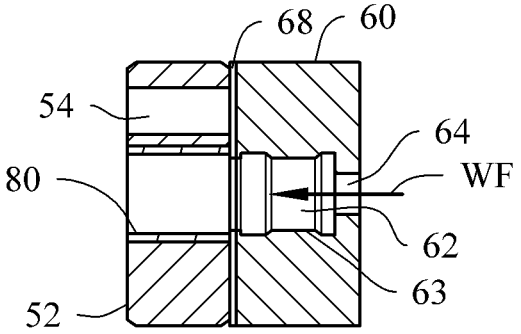

Referring to FIGS. **14*a*-16*b*, the closed, partially opened and fully opened positions of the stationary and oscillating valve heads 52, 60 are shown and will be described in more detail. The closed position, as best illustrated in FIGS. 14*a* and 14*b*, shows the oscillating valve bore 66 not in communication with the stationary valve bore 54. In this closed position, the working fluid WF primarily travels through the first bore 62 by way of the second bore 64 and into the mandrel bore 34 and pushes the piston 50 away from the bypass bores 36**.

Figure 15A:
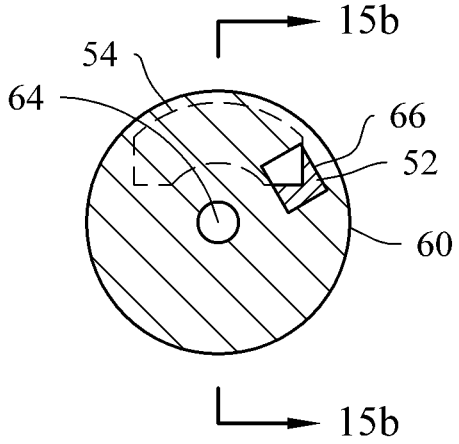
FIGS. 15*a* and 15*b* are cross-sectional views of the oscillating valve assembly in a partially opened position, with FIG. 15*b* taken along line 15*b*-15*b* in FIG. 15*a*.
Figure 15B:
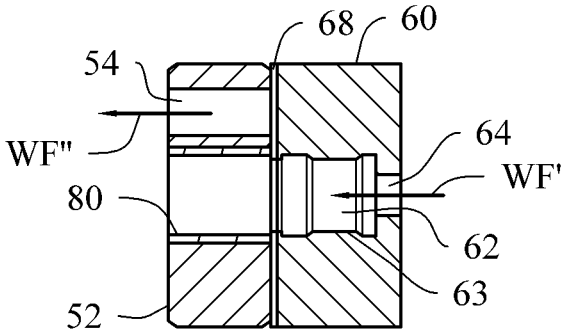

During rotation of the rotor 90, the oscillating valve head 60 rotates into the partially opened position, as best illustrated in FIGS. 15*a* and 15*b*. In this partially opened position, a first portion of the working fluid WF' enters the first bore 62 and a second portion of the working fluid WF" enters the oscillating valve bore 66 and then the stationary valve bore 54 of the stationary valve head 52. The second portion of the working fluid WF" entering the stationary valve bore 54 is dependent on an amount of the oscillating valve bore 66 that is overlapping or in communication with the stationary valve bore 54, as best illustrated in FIG. 15*a*.

It can be appreciated that an amount of the second portion of the working fluid WF" traveling through the stationary valve bore 54 is dependent on the position of the oscillating valve bore 66.

As the oscillating valve head 60 rotates further into the partially opened position, more of the second portion of the working fluid WF" enters the stationary valve bore 54 resulting in a decrease of pressure of the first portion of working fluid WF' acting against the piston 50. When the first portion of the working fluid WF' is a predetermined pressure, the spring 48 will push the piston 50 into a blocking position covering the bypass bores 36, thereby stopping the first portion of the working fluid WF' from entering the mandrel bore 34.

It can be appreciated that the amount of the first and second portions of the WF', WF" entering the first bore 62 and the oscillating valve bore 66 is dependent on the rotational position of the oscillating valve bore 66 in relation with the stationary valve bore 54.

Figure 16A:
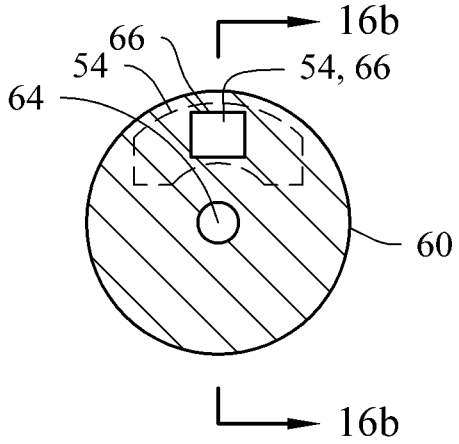
FIGS. 16*a* and 16*b* are cross-sectional views of the oscillating valve assembly in a fully opened position, with FIG. 16*b* taken along line 16*b*-16*b* in FIG. 16*a*.
Figure 16B:
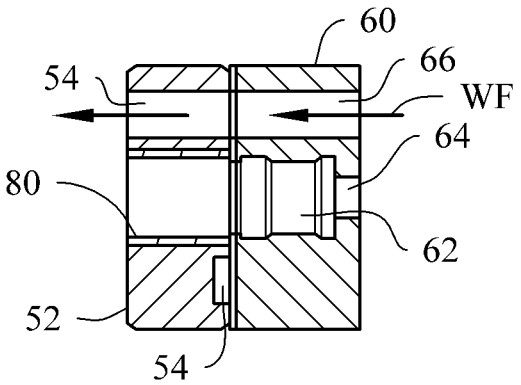

During further rotation of the rotor 90, the oscillating valve head 60 rotates into the fully opened position, as best illustrated in FIGS. 16*a* and 16*b*. In this fully opened position, oscillating valve bore 66 is fully or substantially aligned with the stationary valve bore 54, thereby allowing the working fluid WF to freely travel through the stationary and oscillating valve bores 54, 66. It can be appreciated that a small amount of working fluid may travel through the first bore 62 by way of the second bore 64 and into the mandrel bore 34, however the fluid pressure would not be sufficient to push the piston 50 away from the bypass bores 36.

According to one aspect and in the exemplary, the present technology can include a pulsation valve system 10 including a bypass mandrel 30, an oscillating valve head 60 and a stationary valve head 52. The mandrel 30 can be operably coupled to a rotor 90 of a pulsation assembly 70. The mandrel 30 can include a mandrel bore 34 defined through a first mandrel end 38 and along a longitudinal axis of the mandrel 30. The mandrel 30 can further include bypass bores 36 defined at an angle through the mandrel 30 and in communication with the mandrel bore 34.

A spring 48 can be locatable in the mandrel bore 34, and a piston 50 can be slidably receivable in the mandrel bore 34 in operable contact with the spring 48. The piston 50 can be configured to block an entrance of the bypass bores 36 from inside the mandrel bore 34 at a first position and to allow fluid to flow into the bypass bores 36 from inside the mandrel bore 34 at a second position.

The oscillating valve head 60 can be attachable to the mandrel 30 and rotatable with the mandrel 30. The oscillating valve head 60 can include an oscillating valve bore 66 defined therethrough and parallel with a longitudinal axis of the oscillating valve head 60.

The stationary valve head 52 can be positioned adjacent and stationary with respect to the oscillating valve head 60. The stationary valve head 52 can include a stationary valve bore 54 defined therethrough and parallel with a longitudinal axis of the stationary valve head 52. The oscillating valve bore 66 can be alignable with the stationary valve bore 54 at predetermined rotational positions.

The mandrel bore 34 can be in communication with a first central bore 62 of the oscillating valve head 60.

The spring 48 can be configured to allow the piston 50 to move to the second position when a predetermined fluid pressure is provided on the piston 50 from the mandrel bore 34 received from the first central bore 62.

According to another aspect and in the exemplary, the present technology can include a method of using a pulsation valve system 10 for oscillating fluid flow to a pulsation assembly 70. The method can include the steps of flowing a working fluid WF to an oscillating valve head 60 that is attachable to a mandrel 30 operably coupled to a rotor 90 of the pulsation assembly 70, and then to the rotor 90 of the pulsation assembly 70 to impart rotation of the mandrel 30 and the oscillating valve head 60 with respect to a stationary valve head 52 positioned adjacent and stationary with respect to the oscillating valve head 60. Then rotating the oscillating valve head 60 so that an oscillating valve bore 66 defined through the oscillating valve head 60 comes in and out of alignment with the stationary valve bore 54 defined through the stationary valve head 52. Controlling a flow of the working fluid WF entering the pulsation assembly 70 dependent on the rotational location of the oscillating valve bore 66 in relation to the stationary valve bore 54.

In some or all embodiments, an amount of fluid entering the stationary valve bore can be dependent on a rotational location of the oscillating valve bore in relation with the stationary valve bore.

In some or all embodiments, the stationary valve bore can have a size greater than the oscillating valve bore.

In some or all embodiments, the stationary valve bore can have a radial length greater than a width of oscillating valve bore.

In some or all embodiments, the stationary valve bore can be offset from a stationary valve central bore defined through the stationary valve head. The stationary valve bore is not in communication with the stationary valve central bore.

In some or all embodiments, the stationary valve head can be fixedly secured in a first end bore of a valve assembly housing. The first end bore of the valve assembly housing can be configured to rotatably received the oscillating valve head and at least a portion of the mandrel.

Some or all embodiments of the present technology can include a bushing located in a stationary valve central bore. The bushing can be configured to rotatably and axially receive a valve end section of the mandrel.

In some or all embodiments, the valve end section of the mandrel can be receivable and secured in a second oscillating valve central bore defined in the oscillating valve head. The second oscillating valve central bore can have a size greater than a first oscillating valve central bore defined in the oscillating valve head and is in communication therewith.

In some or all embodiments, the oscillating valve head can include channels radially defined in an oscillating valve face of the oscillating valve head adjacent to a stationary valve face of the stationary valve head. The channels can be configured to allow fluid to travel between the stationary valve head and the oscillating valve head to an open area between an internal area of the bushing and an external surface of the valve end section.

In some or all embodiments, the mandrel can include a mandrel bore defined through a first mandrel end and along a longitudinal axis of the mandrel. The mandrel can further include bypass bores defined at an angle through the mandrel and in communication with the mandrel bore. The mandrel bore can be in communication with a first oscillating valve central bore of the oscillating valve head.

Some or all embodiments of the present technology can include a spring located in the mandrel bore.

Some or all embodiments of the present technology can include a piston slidably received in the mandrel bore in operable contact with the spring. The piston can be configured to block an entrance of the bypass bores from inside the mandrel bore at a first position and to allow fluid to flow into the bypass bores from inside the mandrel bore at a second position.

In some or all embodiments, the spring can be configured to allow the piston to move to the second position when a predetermined fluid pressure is provided on the piston from the mandrel bore received from the first oscillating valve central bore.

Some or all embodiments of the present technology can include a flexshaft connected to a second end of the mandrel. The flexshaft can be operably connecting to the rotor of the pulsation assembly.

In some embodiment, the clearance or size of the stationary valve bore 54 can control a pulsation magnitude being: a smaller clearance or size=larger pulsation magnitude; and a larger clearance or size=smaller pulsation magnitude.

In some embodiment, the size of the oscillating valve bore 66 can control a pulsation magnitude being: a smaller size=larger pulsation magnitude; and a larger size=smaller pulsation magnitude.

With reference to FIGS. 17-25, an embodiment of the downhole agitation motor valve system and method of the present technology is shown and generally designated by the reference numeral 140. The downhole agitation motor valve system and method 140 can be utilized for use in connection with providing oscillating fluid flow to a BHA 8, downhole tool or a drilling motor device or assembly 142, 230 for reducing friction acting on a tool string 2 and/or advancing the tool string.

At least one general principle with operation of any or all embodiments of the present technology can be laid out by water hammer theories such as by Nikolay Yegorovich Zhukovsky (Joukowsky). Theories such as this can be utilized to maximize performance of the present technology and/or minimizes a water hammer potential. Water hammer is part of the larger subject of transient flow or surge analysis brought upon by a sudden change in flow velocity. In most cases this occurs when a valve closes quickly, and in the present case when the oscillating valve head rotates in relation to the stationary valve head. Water hammer can generate very high pressure transients which could generate pipeline vibrations and/or agitation forces.

The pressure profile of the water hammer pulse can be calculated from the Joukowsky equation (Equation 1).

$$\frac{\partial P}{\partial t} = \rho a \frac{\partial v}{\partial t} \qquad \text{Equation 1}$$

Accordingly, for a valve closing instantaneously, the maximal magnitude of the water hammer pulse can be solve using Equation 2

$$\Delta P = \rho a_0 \Delta v \qquad \text{Equation 2}$$

where ΔP is the magnitude of the pressure wave in pascal (Pa), ρ is the density of the fluid (kg/m$^3$), $a_0$ is the speed of sound in the fluid (m/s), and Δv is the change in the fluid's velocity (m/s). The pulse comes about due to Newton's laws of motion and the continuity equation applied to the deceleration of a fluid element.

The sonic velocity is the speed of sound in the pipe and is determined by a modified hooks law formula which takes into account the stiffness of the fluid and the pipe wall as per Equation 3

$$C = \sqrt{\frac{1}{\rho\left[\frac{1}{K} + \frac{D}{Ee}\right]}} \qquad \text{Equation 3}$$

where K is the Bulk modulus of fluid, E is the Young's modulus of pipe material, and e is the wall thickness of pipe.

The sonic velocity is also the speed at which the pressure waves generated by water hammer travel in the pipe.

Figure 17:
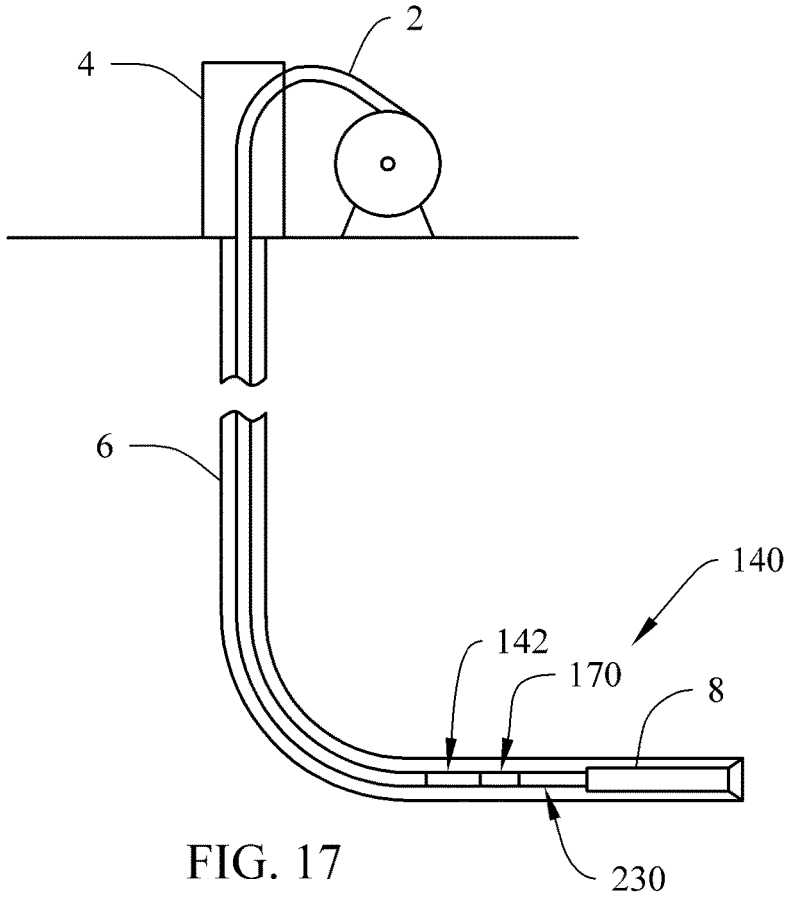
FIG. 17 illustrates a well site system utilizing an embodiment of the downhole pulsation valve system and method in association with a drilling motor assembly and constructed in accordance with the principles of the present technology.
Figure 18:
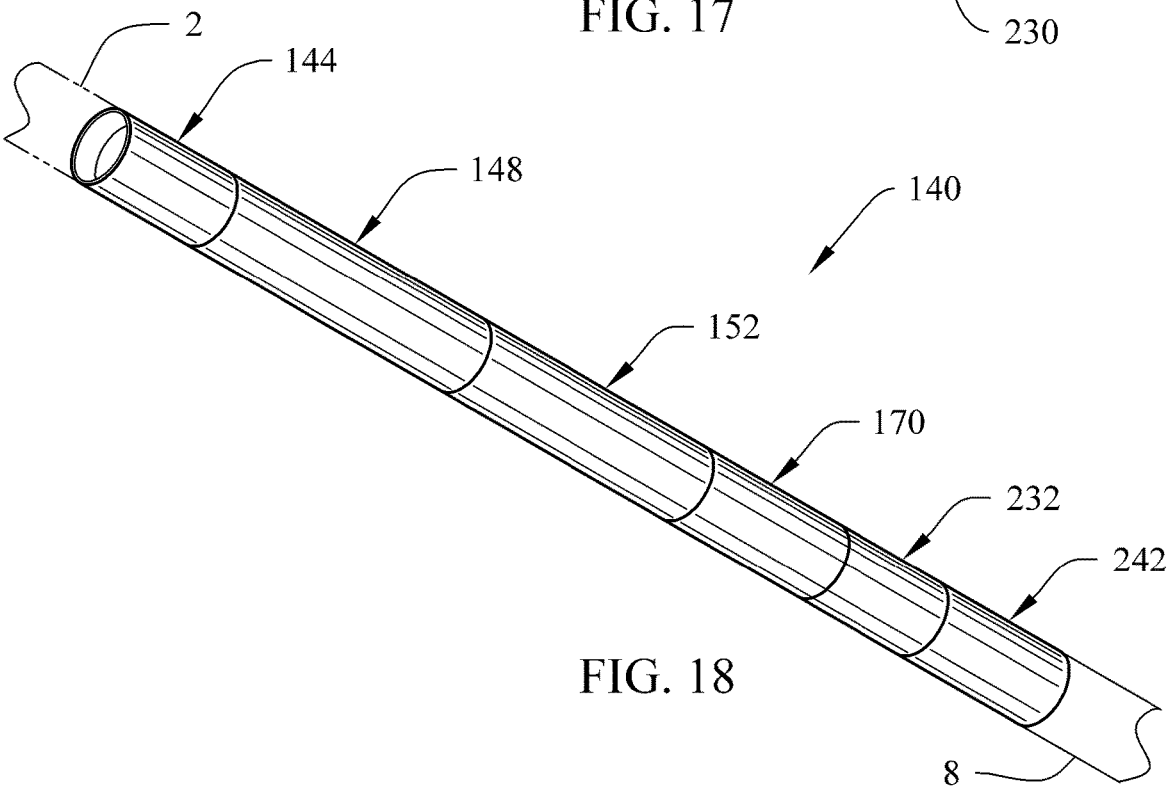
FIG. 18 is a perspective view of an assembled downhole pulsation valve system and method of the present technology.

In FIGS. 17 and 18, a new and novel downhole agitation motor valve system and method 140 of the present technology for reducing friction acting on a tool string and/or advancing the tool string by generating and utilizing pressure pulsations is illustrated and will be described. In the exemplary, the downhole agitation motor valve system and method 140 can be utilized with a drill string or coiled tubing 2 that is associated with the BHA 8 in a wellbore 6 as described above in typical operation. In the exemplary, the BHA can be a drilling motor assembly including a power unit 142 and a mandrel/bearing unit 230. The power unit 142 can include a stator/rotor assembly housing 148 in series with a flexshaft assembly housing 152 and other applicable and/or modular tool assemblies, such as a top sub 144 connectable to the drill string 2, as best illustrated in FIG. 18.

A modular valve unit 170 can be connectable between the stator/rotor assembly housing 148 and the flexshaft assembly housing 152, to provide oscillating flow and/or agitation to the BHA 8 downhole thereof.

The modular valve unit 170 of the present technology can be a modular component to known downhole motors, designed to be added, removed or interchanged from a build based on customer request. The benefit of this is to have the option of modifying a motor that has gone into the field based upon varying conditions downhole. It can be appreciated that the modular valve unit 170 can alternatively be an integral component of the downhole motor to create a single downhole motor assembly.

Figure 19:
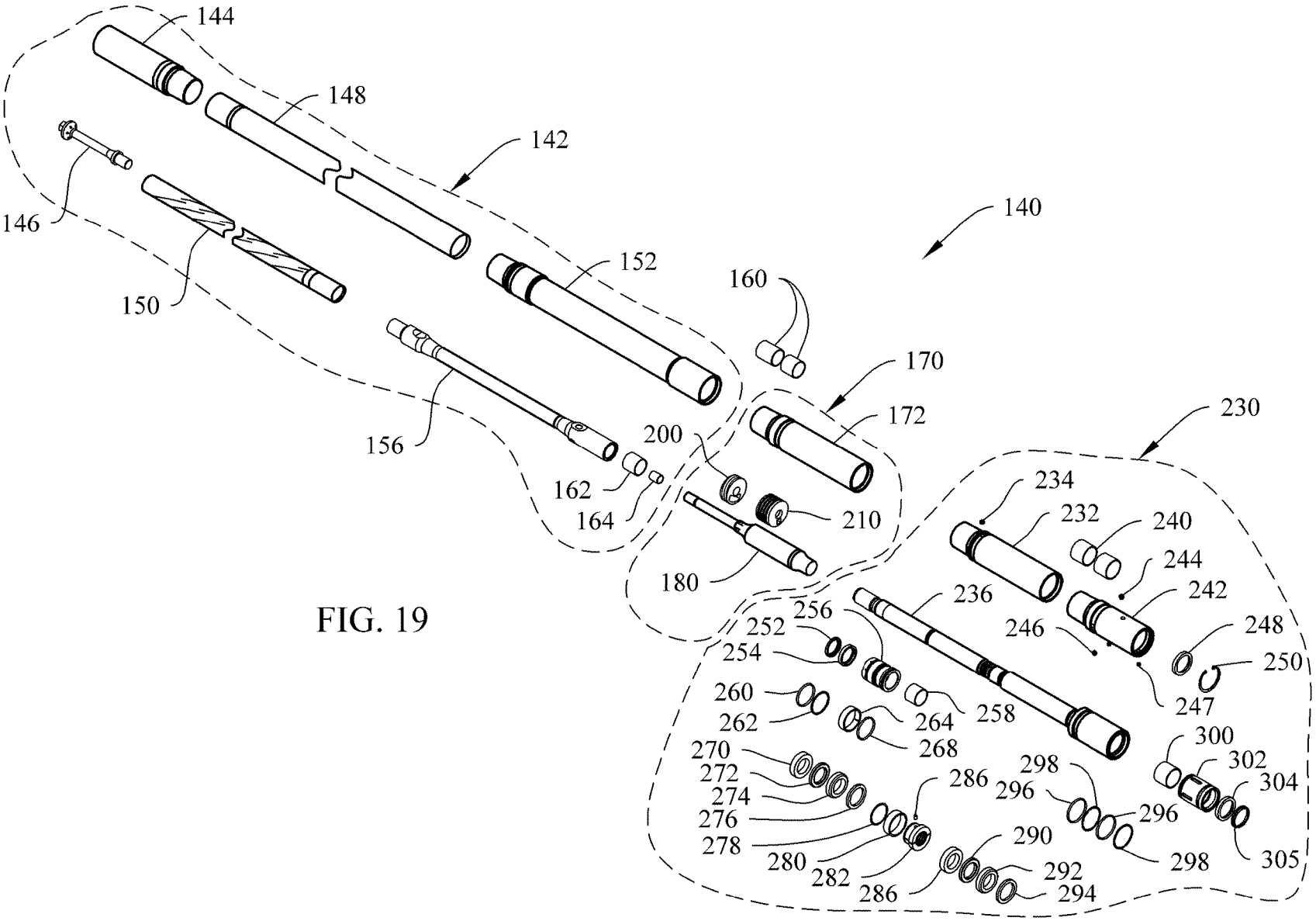
FIG. 19 is an exploded perspective view the downhole agitation motor valve system and method of the present technology.

Referring to FIG. 19, the overall drill motor will be described, starting with the power unit 142. The top sub 144 of can be connected to the stator/rotor motor assembly housing 148, and can be furnished with an internal shoulder feature, which is essential to a function of a rotor catch 146. The stator/rotor housing 148 threadably connects to the top sub 144 of the stator/rotor motor assembly 148 rather than the stator itself.

The stator/rotor housing 148 housing a stator that rotatably receives a rotor 150. An internal bore of the stator/rotor housing 148 receives working fluid from the drill string 2, which in turn rotates the rotor 150 therein.

A flexshaft housing 152 can be connected to the stator/rotor housing 148, which can include a flexshaft 156 rotatably received therein. An internal bore of the flexshaft housing 152 receives working fluid from the internal bore of the stator/rotor housing 148 that exits the rotor 150. It can be appreciated that rotation of the rotor 150 consequently rotates the flexshaft 156.

A bushing can be configured to not axially constrain or limit the axial movement of the rotor 150, which may be already constrained by a bearing pack of a drilling or stator/rotor motor assembly 148. As such, an expansion/retraction (telescoping) feature can be provided at some location in between the rotor 150 and the bushing.

Referring to FIGS. 20-25, the module valve unit 170 can be locatable in a middle or central section of a downhole motor assembly so that a distance from the bearing pack unit 230 to the BHA 8 or drill bit (not shown) is low or as low as possible. This short distance can be a benefit as forces seen by the drill bit do not produce a high bending moment and introduce high bending force onto a bearing mandrel 236.

Figure 23:
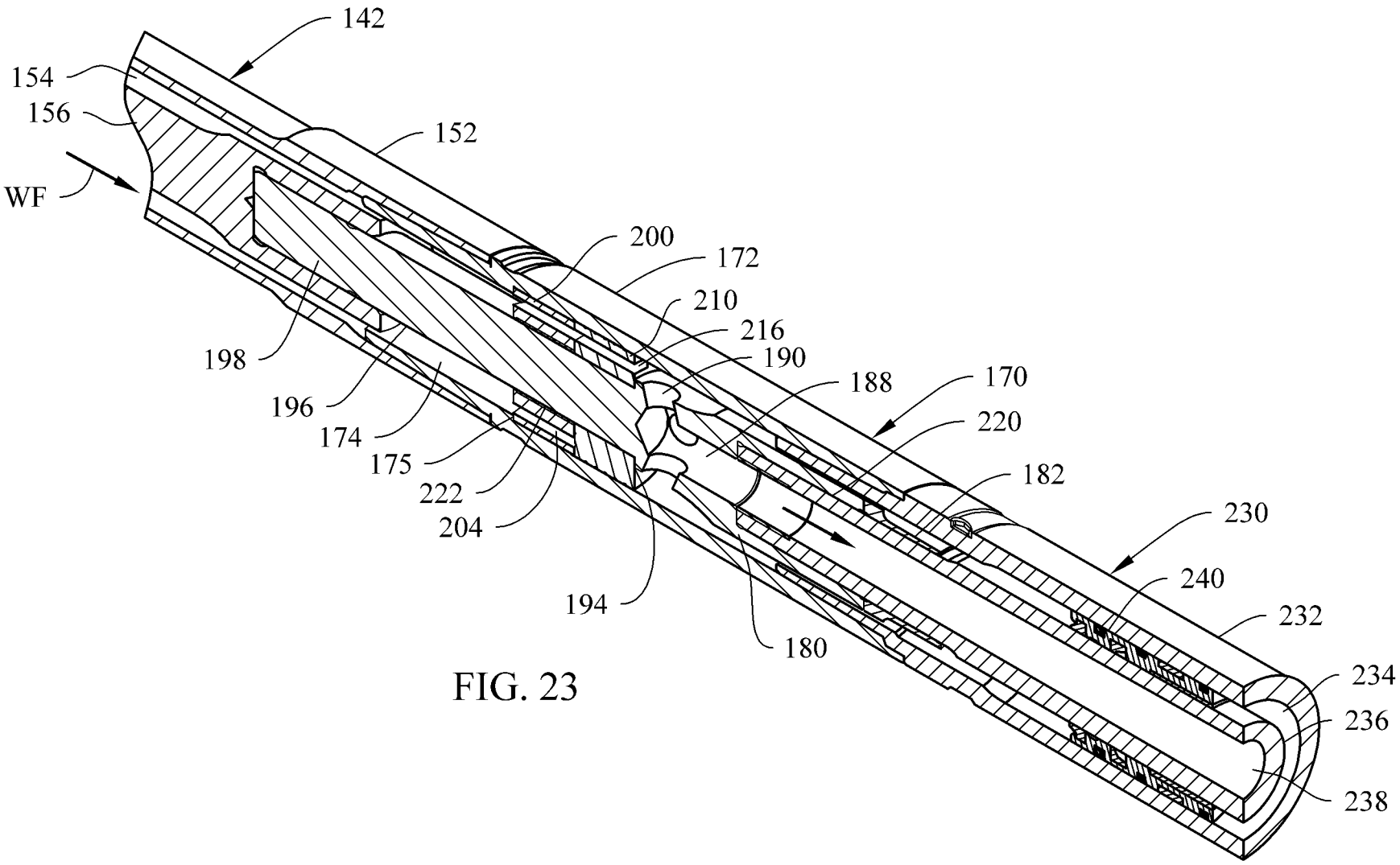
FIG. 23 is a cross-section perspective view of the valve assembly of the downhole agitation motor valve system.

In the exemplary, the module valve unit 170 can include a valve assembly housing 172 including a first end 176 attachable to a thrust housing 232 of the bearing unit 230, and a second end 178 attachable to flexshaft housing valve assembly housing 152. The valve assembly housing 172 can define a hollow interior configured as a longitudinal valve housing bore 174 extending therethrough and featuring a first section having a width or diameter greater than a second section thereby creating a stop ledge 175, as best illustrated in FIG. 23. Operatively associated within the valve housing bore 174 can be a valve mandrel 180, a stationary valve head 200, and an oscillating valve head 210.

The module valve unit 170 can be designed to open fast, and close slowly utilizing the stationary and oscillating valve heads 200, 210. This minimizes the water hammer potential while increasing a surge pulsation. At least one advantage of this is in assisting a pull of the downhole agitation motor valve system 140 uphole, limiting the possibility of producing too high of weight on the drill bit and stalling the motor.

The module valve unit 170 can be configured so that pulsations created by the stationary and oscillating valve heads 200, 210 encounter no bypass, ensuring the power unit 142 and/or the drill bit receives constant and predictable pulsations.

The valve unit 170 is a reliable system that uses rotation of the rotor 150 to produce the pulsations. The benefit of this is that the systems of rotation are already in place, not requiring much additional length to the tool.

The valve mandrel 180 can include a connection collar or first mandrel end 182 defining a longitudinal bore 184 featuring an internal threaded section engageable with a corresponding end section of the bearing mandrel 236, as best illustrated in FIG. 23. It can be appreciated that the first mandrel end 182 can include external threaded that is engageable with internal threaded of the bearing mandrel 236.

A longitudinal valve mandrel cavity 188 can be defined through the first mandrel end 182 and into in a central section 186. The central section 186 can have a width or diameter larger than a shaft section 196 of the valve mandrel 180. The valve mandrel cavity 188 can be defined along a longitudinal axis of the valve mandrel 180 from the first mandrel end 182 and terminating in the central section 186. It can be appreciated that the valve mandrel cavity 188 may not be defined through entire the valve mandrel 180.

A first section 220 of the valve mandrel cavity 188 can have a width or diameter larger than a remaining section of the valve mandrel cavity 188. This first section 220 can be configured to engageably receive a connection end of the bearing mandrel 236, thereby coupling the valve mandrel 180 with the bearing mandrel 236 and providing the valve mandrel cavity 188 in fluid communication with a longitudinal bore 238 of the bearing mandrel 236.

Multiple lateral ports or bores 190 can be radially defined through the valve mandrel 180 at an angle with and in communication with the valve mandrel cavity 188. The angle of the lateral bores 190 can be from the valve mandrel cavity 188 toward the end section of the flexshaft 156 or in a direction of receiving a flow of a working fluid. The lateral bores 190 can be defined in a transitional section 192 that includes a reducing width or diameter from the central section 186 and the shaft section 196. This transitional section 192 can have a width or diameter that is less than the central section 186 and greater than a width or diameter of the shaft section 196, thereby creating a stop ledge 194.

The shaft section 196 can extend from the transitional section 192 and can include a second connection end 198 that can feature external threading that is engageable with internal threading of an end section of the flexshaft 156. It can be appreciated that the second connection end 198 can include internal threading that is engageable with external threading of an end section of the flexshaft 156. It can be further appreciated that a torque nut 162 and a carbide mandrel ring 164 can be utilized in the connection between the second end section 198 and the flexshaft 156.

When assembled, rotation of the rotor 150 provides rotation of the flexshaft 156 and the valve mandrel 180.

The stationary valve head 200 can be receivable and fixable in the first section of the valve housing bore 174 of the valve assembly housing 172 so as to abut against the stop ledge 175 created between the first and second sections of the valve housing bore 174. The stationary valve head 200 can include a stationary valve central bore 202 configured to receive a bushing that can be configured to rotatably received the shaft section 196 of the valve mandrel 180. The stationary valve central bore 202 can be defined along a longitudinal axis of the stationary valve head 200.

A stationary valve bore 204 can be defined through the stationary valve head 200 in a direction parallel with a longitudinal axis of the stationary valve central bore 202, and can have concentric arcuate or planar edges and parallel sides. With this configuration, the stationary valve bore 204 can have a width measured between its sides that is greater than a width or diameter of the stationary valve central bore 202. Further in this configuration, the stationary valve bore 204 can be offset from the stationary valve central bore 202 along their parallel longitudinal axes.

An exterior surface of the stationary valve head 200 can include coupling means or threading 208 that is configured to engage with coupling means or threading located internally in the valve housing bore 174 of the valve assembly housing 172. This allows the stationary valve head 200 to be non-rotatably fixed inside the valve housing bore 174, as best illustrated in FIG. 23. In the exemplary, rotating the stationary valve head 200 threadably secures it to the valve assembly housing 172 until contact with the stop ledge created between the first and second sections of the valve housing bore 174, thereby securing the stationary valve head 200 in place.

It can be appreciated that the stationary valve head 200 can have a non-cylindrical exterior configuration corresponding to a same non-cylindrical configuration of a receiving section of the valve housing bore 174, thereby prohibiting the stationary valve head 200 from rotating when received therein.

A bushing 222 can be received in the stationary valve central bore 202 and can be configured for receiving the smooth exterior surface portion of the shaft section 196. The bushing can allow for smooth and free rotation of the shaft section 196 of the valve mandrel 180 within the stationary valve central bore 202 of the stationary valve head 200. Further, the bushing 222 can be easily replaced if significant wear or damage is detected on the bushing. It can be appreciated that the bushing 222 can be a sacrificial part as compared to the shaft section 196 and/or the stationary valve head 200, and can be made of any suitable material.

The oscillating valve head 210 can be receivable and rotatable in the valve housing bore 174 of the valve assembly housing 172. The oscillating valve head 210 can include a longitudinal oscillating valve central bore 212 featuring an outwardly tapering section 214 in communication with the oscillating valve central bore 212. The oscillating valve central bore 212 can include coupling means or internal threading configured to engage with the external threading of the shaft section 196 of the valve mandrel 180. This allows the oscillating valve head 210 to be attachable to the shaft section 196 adjacent and/or abutting to the stop ledge 194 of the valve mandrel 180 and rotatable therewith. The oscillating valve head 210 can include an oscillating valve bore 216 defined therethrough and parallel with a longitudinal axis of the oscillating valve head 210 and the oscillating valve central bore 212

Figures 20, 21, 22:
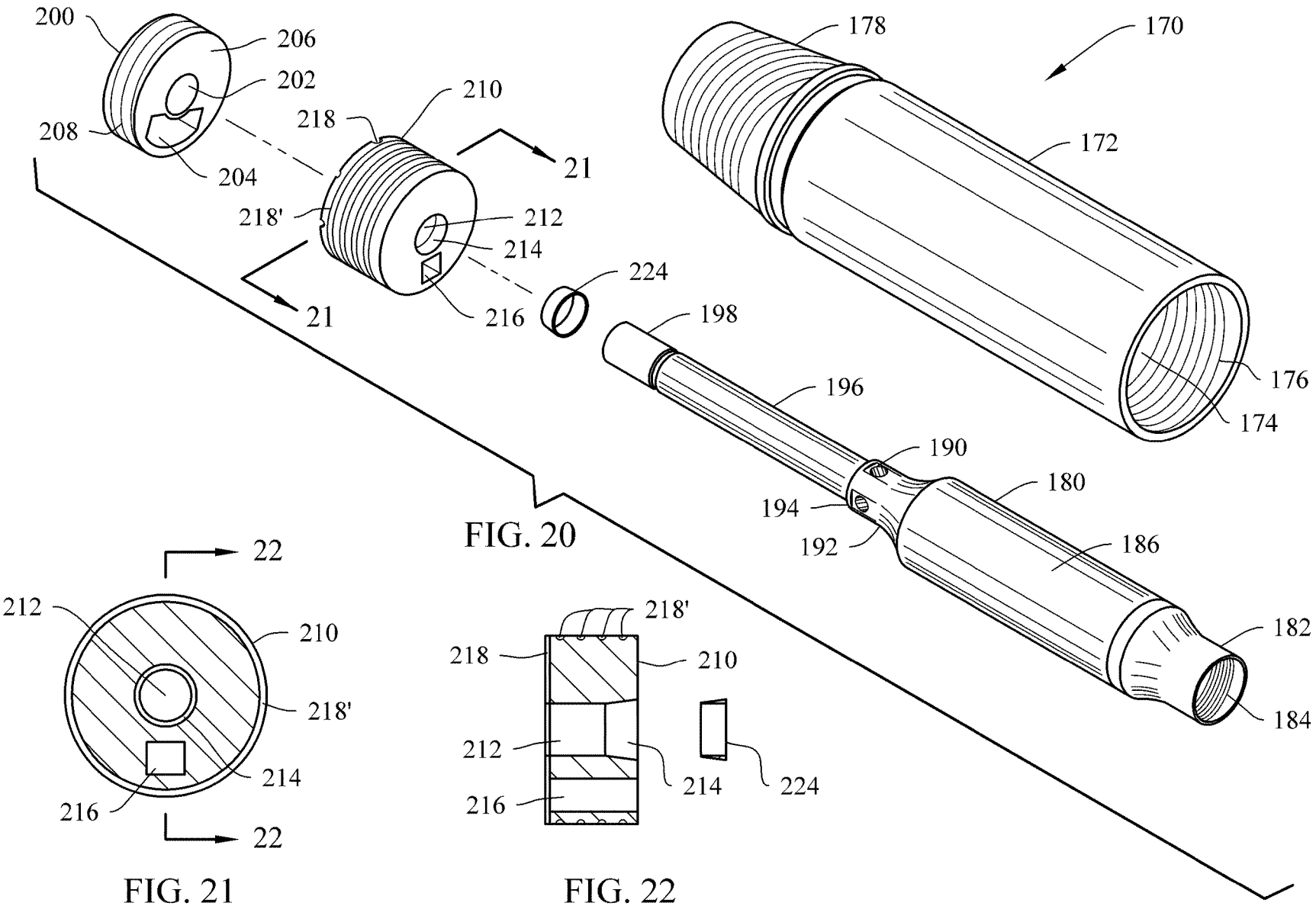
FIG. 20 is an exploded perspective view of the valve assembly of the downhole agitation motor valve system of the present technology.
FIG. 21 is a cross-sectional view of the oscillating valve head taken along line 21-21 in FIG. 20.
FIG. 22 is a cross-sectional view of the oscillating valve head with the ring wedge exploded taken along line 22-22 in FIG. 21.

The tapering section 214 of the oscillating valve central bore 212 can define an entry opening with a width or diameter greater than oscillating valve central bore 212 to create a tapered section. The tapering section 214 can be configured to receive a ring wedge 224 that is slidably received along the shaft section 196 and is contactable with the stop ledge 194. The ring wedge 224 includes a tapered outer surface that corresponds with the tapering section 214 so that the widest side of the ring wedge 224 contacts the stop ledge 194, as best illustrated in FIGS. 22 and 23

The shaft section 196 of the valve mandrel 180 can be receivable in and through the oscillating valve central bore 212 of the oscillating valve head 210. The shaft section 196 can further include an external threaded section near or adjacent to the stop ledge 194, which is engageable with internal threading included with the oscillating valve central bore 212.

With the ring wedge 224 positioned on the shaft section 196, it can be appreciated that rotation of the oscillating valve head 210 will secure it to the shaft section 196 in combination with the ring wedge 224 being received in the tapering section 214. Further rotation of the oscillating valve head 210 will force the oscillating valve head 210 against the ring wedge 224 that abuts the stop ledge 194, thereby securely fitting the oscillating valve head 210 in place on the shaft section 196.

A cross-sectional or lateral profile of the oscillating valve bore 216 can be the same or less than a cross-sectional or lateral profile of the stationary valve bore 204. Alternatively, a radial length of the stationary valve bore 204 can be greater than a width or diameter of the oscillating valve bore 216.

A location of the oscillating valve bore 216 can be offset from the oscillating valve central bore 212 and alignable with the stationary valve bore 204 when the stationary valve head 200 and the oscillating valve head 210 are assembled in the valve assembly housing 172. In this configuration, the oscillating valve bore 216 can be in or out of communication with the stationary valve bore 204 during rotation of the oscillating valve head 210 in relation with the stationary valve head 200.

It can be appreciated that the oscillating valve bore 216 can have a size smaller than that of the stationary valve bore 204, thereby allowing the oscillating valve bore 216 to be in communication with the stationary valve bore 204 at predetermined radial positions. The amount of time the oscillating valve bore 216 and the stationary valve bore 204 are in communication with each other can be dependent on the size of the size of the stationary valve bore 204, the oscillating valve bore 216, the number of stationary valve bores 204, the number of oscillating valve bores 216, and/or the rotational speed of the oscillating valve bores 216.

Grooves or slots can be defined in an internal surface defining the valve housing bore 174 of the valve assembly housing 172, and configured to retaining fluid on an outside of the oscillating valve head 210 thereby creating a hydrodynamic bearing between the perimeter of the oscillating valve head 210 and the valve housing bore 174.

An end side of the oscillating valve head 210 that faces a corresponding end side 206 of the stationary valve head 200 when assembled can include a plurality of channels 218. The channels 218 can be radially defined in communication with an exterior of the oscillating valve head 210 and the valve housing bore 174. It can be appreciated that the channels 218 can be further defined radially in communication with an exterior of the stationary valve head 200 and the stationary valve central bore 202. These channels 218 can be configured to allow fluid to flow between adjacent surfaces of the stationary valve head 200 and the oscillating valve head 210 allowing for lubrication therebetween, as well as a contact area between the bushing and the shaft section 196 of the valve mandrel 180.

As best illustrated in FIG. 22, the oscillating valve head 210 can further include external channels 218' defined in an external side of the oscillating valve head 210 that face an internal surface of the valve assembly housing 172 that defines the first section of the valve housing bore 174, and wherein the external channels 218' can be configured to allow fluid to travel between an open area between internal surface of the valve assembly housing 172 and the external side of the oscillating valve head 210 allowing for lubrication therebetween. The external channels 218' can be included alone or in combination with the channels 218.

When the oscillating valve head 210 is secured to the shaft section 196, it can be appreciated that the second connection end 198 is insertable through the bushing and as such the stationary valve central bore 202 of the stationary valve head 200. When assembled, the oscillating valve head 210 is positioned between the stop ledge 194 and the end side of the stationary valve head 200.

When assembled, it can be appreciated that the ring wedge 224 is slidable received along the shaft section 196 of the valve mandrel 180 so as to be abutting or adjacent the stop ledge 194. Then, the oscillating valve head 210 can be secured to the shaft section 198 so that the ring wedge 224 is received in the tapering section 214 of the oscillating valve central bore 212. This attachment can be accomplished by rotating the oscillating valve head 210 so that mutually engageable threads tighten the oscillating valve head 210 to the shaft section 196 while pressing the ring wedge 224 against the stop ledge 194 and the tapering section 214, thereby securing the oscillating valve head 210 in place.

The stationary valve head 200 can be secured in the first section of the valve housing bore 174 of the valve assembly housing 172 so as to abut or be adjacent to the stop ledge 175. This attachment can be accomplished by rotating the stationary valve head 200 so that mutually engageable threads tighten the stationary valve head 200 in the first section of the valve housing bore 174. Continued rotation of the stationary valve head 200 can press the stationary valve head 200 against the stop ledge 175, thereby securing the stationary valve head 200 in place.

After which, the shaft section 196 of the valve mandrel 180, with the oscillating valve head 210 fitted thereto, can be insertable through the bushing 222, and as such the stationary valve central bore 202 of the stationary valve head 200, until the stationary valve head 200 and the oscillating valve head 210 are adjacent to each other. In this arrangement, the channels 218 can be facing the side 206 of the stationary valve head 200, with the stationary valve head 200 and the oscillating valve head 210 being located between the stop ledge 175 and stop ledge 194.

The second connection end 198 of the shaft section 196 can then be attached to the flexshaft 156. Further, the first mandrel end 182 of the valve mandrel 180 can be attached to the bearing mandrel 236 of the bearing unit 230.

In this arrangement, the oscillating valve head 210 can freely rotate in the first section of the valve housing bore 174 of the valve assembly housing 172 upon rotation of the valve mandrel 180 by the flexshaft 156, which is rotated by the rotor 150.

When assembled, the stationary valve head 200 can be positioned adjacent to and stationary with respect to the oscillating valve head 210. The oscillating valve bore 216 can be alignable with the stationary valve bore 204 at predetermined rotational positions of the oscillating valve bore 216 as per rotation of the valve mandrel 180.

In some embodiments, the oscillating valve head 210 can be driven by the rotor 150 of a stator/rotor motor assembly 142 situated directly downstream of the present technology system. The drilling motor's rotor catch function 288 should be retained. For this reason, the flexshaft 156 is rotationally coupled to a modified rotor catch device 288 rather than directly to the rotor 150 itself.

In the exemplary, the bearing unit 230 can include a thrust housing 232 connectable to the first connection end 176 of the valve assembly housing 172. The thrust housing 232 can be coupled to a bottom piston bearing housing 242 and together can slidably and/or rotatably receive therethrough the bearing mandrel 236. Operatively associated with the bearing mandrel 236 can be a locking bearing 240 operably associated with the locking screw 244, a bottom balancing piston 302, a rod wiper 304 and a backup ring 305. Further, additional and varying types of rod wipers 296, 298 can be utilized between the bearing mandrel 236 and the bottom balancing piston 302.

The bottom piston bearing housing 242 can include a hollow interior, a seal 248 and a snap ring 250. An end of the bottom piston bearing housing 242 can be connected to the drill string 2 or BHA/drill bit 8. A locking screw 246 and seal plugs 247 can be utilized with the bottom piston bearing housing 242.

Additional components that can be utilized with the bearing mandrel 236 and/or bottom balancing piston 302 can be, but not limited to, a spacer race 270, a second housing race 272, a second roller thrust bearing 274, a second shaft race 276, a spiral retaining ring 278. Subsequently or downstream thereof, can include a retainer 280, a split ring 282 including a dowel pin 284, a shaft race 286, a roller thrust bearing 290, a housing race 292 and a thrust bearing setting shim 294.

Still further components that can be utilized with the bearing unit 230 can be, but not limited to, a third rod wiper 260, a fourth wiper rod 262, a wear ring-floating piston 264 and a fifth rod wiper 268 that can be of a type different to that of the third and fourth wiper rods. Associated therewith can be a sixth rod wiper 252, a second rotary shaft seal 254, a floating piston 256 and a floating piston seal 258.

Further to the above description, the flexshaft 156 undergoes nutation as well as rotation at one end due to the complex motion of the rotor 150. At its first connection end, it delivers pure concentric rotation to the valve mandrel 180. In some embodiments, this can be accomplished with the flexshaft 156 having sufficient transverse flexibility. It can be appreciated that other types of driveshafts can be utilized in place of the flexshaft 156.

The cyclic obstruction of the stationary valve bore 204 and/or the oscillating valve bore 216 can lead to a fluctuating total flow area (TFA). The TFA is at a maximum while the stationary and oscillating valve bores 204, 216 are completely unobstructed, as per the fully opened position. The TFA is at a minimum while the stationary and oscillating valve bores 204, 216 are fully obstructed, as per the closed position. The cyclic variation of TFA from its maximum to minimum condition causes a pressure spike within the fluid upstream of the stationary and oscillating valve bores 204, 216. This phenomenon is commonly referred to as "Water Hammer".

The flow rate through the stationary and oscillating valve bores 204, 216 achieves a maximum ($Q_{max}$) while fully unobstructed and reaches a minimum ($Q_{min}$) while fully obstructed. The magnitude of the pressure spike is proportional to the difference between the maximum and minimum flow rate ($\Delta Q = Q_{max} - Q_{min}$).

The time-averaged flow rate through the stationary and oscillating valve bores 204, 216 can be dependent on the pump rate at the surface, which supplies the working fluid downhole. Increasing the pump rate increases $\Delta Q$, which in turn increases the pressure spike magnitude.

The rotational speed of the rotor 150 can be dependent on the pump rate at the surface. Increasing the pump rate increases the rotor's rotational speed. Being that the oscillating valve head 210 is rotationally coupled to the rotor 150, increasing the pump rate will increase the pressure spike frequency.

The magnitude of the pressure spike is also proportional to the "system's" hydraulic impedance, which, from an internal pressure perspective, is a measure of the "system's" rigidity. Hydraulic impedance is generally defined as the ratio of pressure to volume flow rate. The pressure and volume flow variables are treated as phasors in this definition, so possess a phase as well as magnitude. The "system" consists of the upstream fluid itself as well as the tubular components (coiled tubing, etc.) though which the upstream fluid is conveyed. The length of the "system" is the product of the "system's" effective speed of sound and the duration of time that the port(s) is obstructed.

In some embodiments, the stator/rotor motor assembly 142 connects in series into or to the BHA 8, and does not require any input from other BHA components other than fluid communication.

Bearings or the bushing associated with the stationary valve head 200 can be cooled and lubricated via bypass fluid flow in the channels 218 and/or the contact area. The amount of fluid permitted to bypass can be controlled by fluid restrictors. The bypass flow rate ($Q_{bp}$) is substantially smaller than $Q_{min}$.

Some embodiments of the present technology can include the rotor/stator assembly as being installed in series within an existing drilling motor, which does not require modifications to any of the drilling motors components. The oscillating valve head 210 can be rigidly connected in series with the flexshaft 156 of the power unit 142 and the bearing mandrel 236 of the bearing unit 230. Therefore, the oscillating valve head 210 does not require dedicated bearing support since the bearing mandrel 236 is already well supported by the drilling motor's bearings.

Further, because the oscillating valve head 210 is rigidly connected to the flexshaft 156, its rotation is provided via the drilling motor's power section. For this reason, a dedicated means of rotating the oscillating valve head 210, such as a dedicated power section and/or driveshaft, may not require either.

As a further consequence of being rigidly connected in series with the flexshaft 156 and bearing mandrel 236 of the drilling motor, the oscillating valve head 210 can be of sufficient torsional strength to reliably transmit the relatively high torque that a drilling motor's drive-line is subject to.

An additional housing, threadably connected between the flexshaft housing 152 and thrust housing 232, of make-up length corresponding to the oscillating valve head 210 make-up length, can be provided to maintain correct alignment of the drilling motor's drive-line components.

Figure 24:
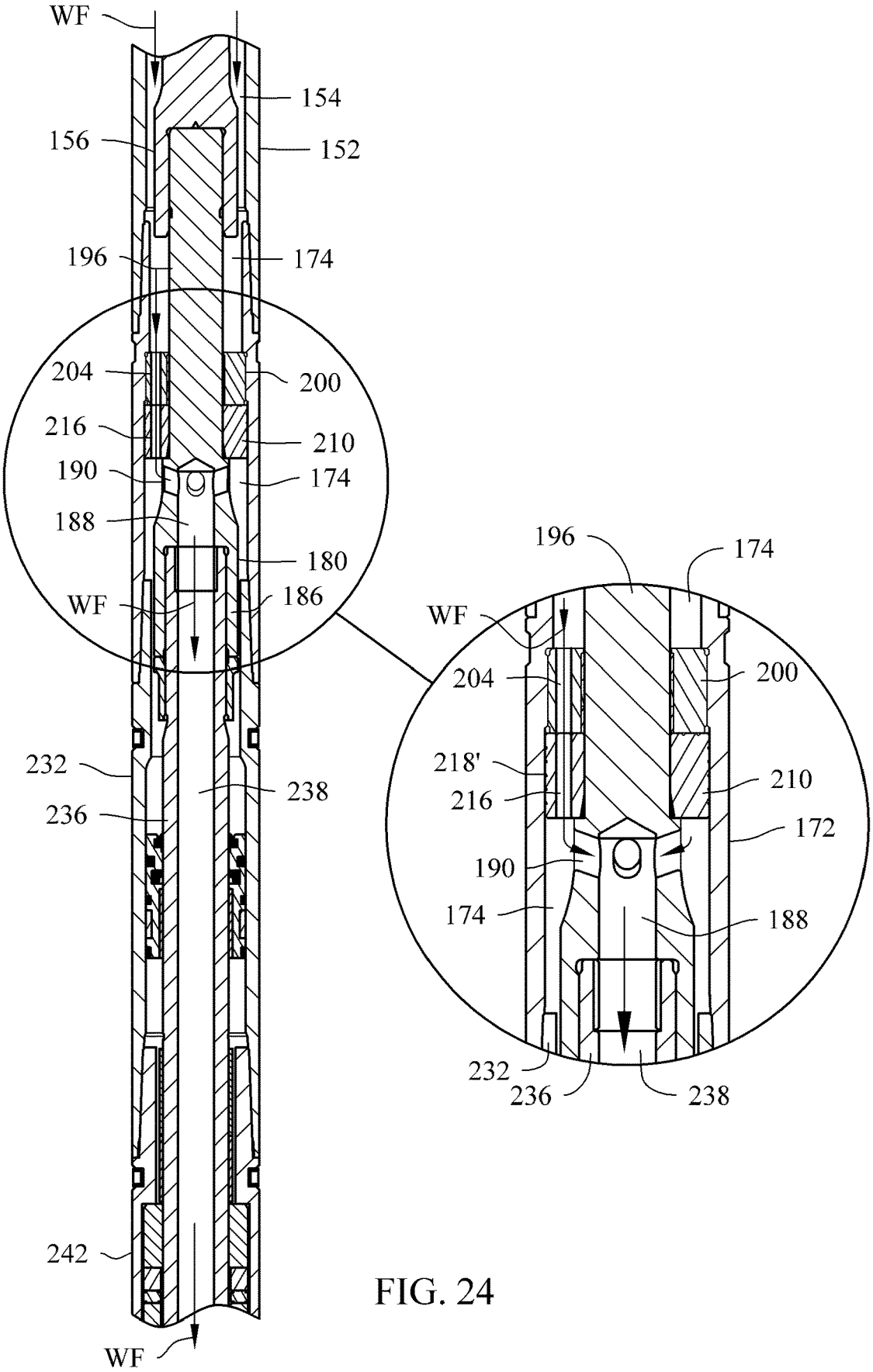
FIG. 24 is a cross-sectional view of the oscillating valve assembly in an opened position.
Figure 25:
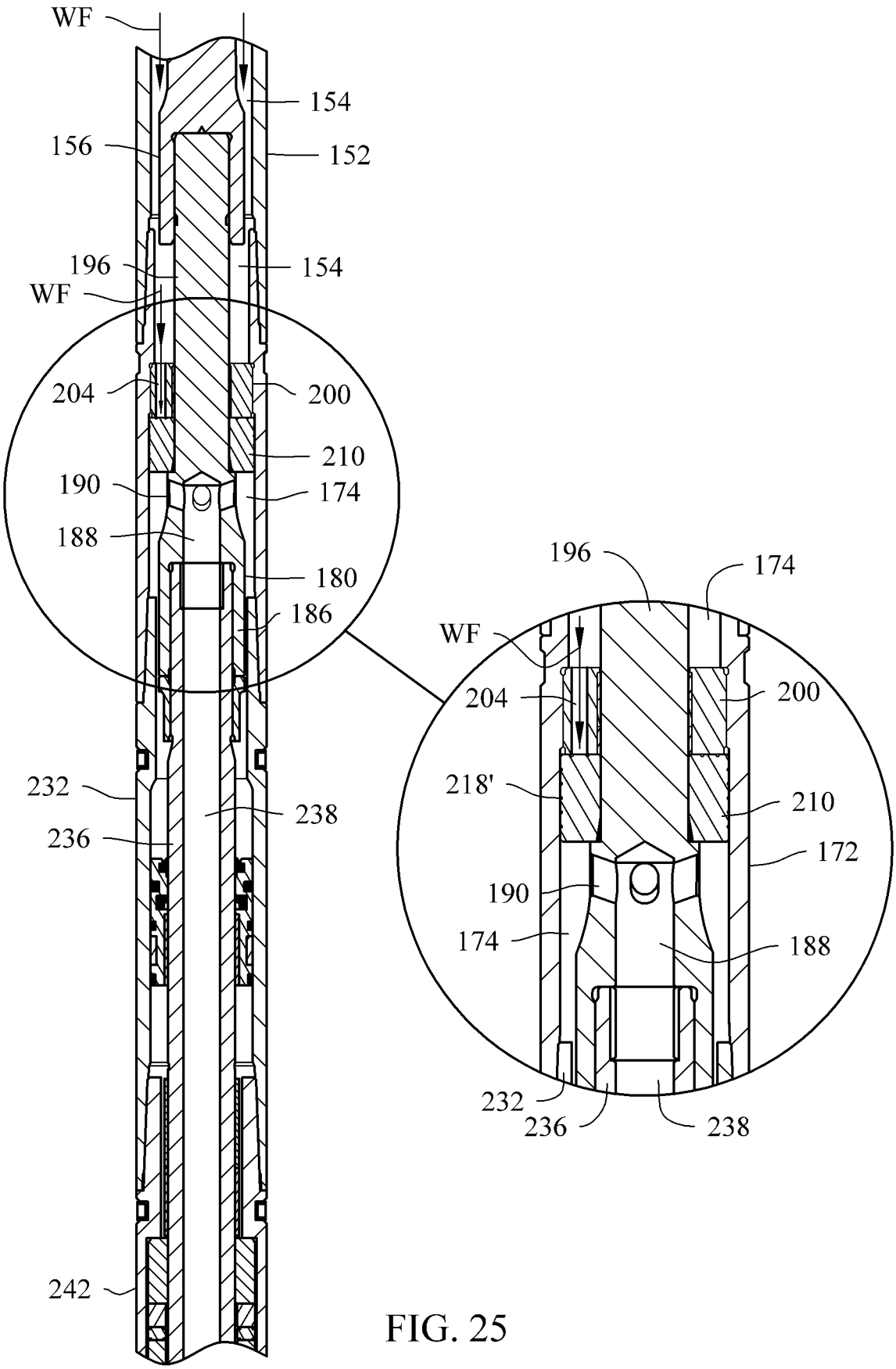
FIG. 25 is a cross-sectional view of the oscillating valve assembly in a closed position.

Referring to FIGS. 24 and 25, the fully opened and closed positions of the stationary and oscillating valve heads 200, 210 are shown and will be described in more detail. Working fluid WF is pumped down the drill string 2 and into the stator/rotor housing 148 of the power unit 142. The flow of the working fluid WF initiate rotation of the rotor 150 as is travels between the stator and the rotor 150. The working fluid WF continues through a longitudinal flexshaft housing bore 154 of the flexshaft housing 152, and consequently over the flexshaft 156. It can be appreciated that rotation of the rotor 150 by the flow of the working fluid WF also rotates the flexshaft 156, which in turn rotates the valve mandrel 180 and the oscillating valve head 210. The working fluid WF can continue into the valve housing bore 174 and into the stationary valve bore 204.

In the fully or partially opened position, oscillating valve bore 216 is fully or substantially aligned with the stationary valve bore 204. The working fluid WF is then allowed to freely travel from the stationary valve bore 204 and through the oscillating valve bore 216, and then through the lateral ports 190 and into the valve mandrel cavity 188. After which, the working fluid WF can then flow through the valve mandrel cavity 188 and into the longitudinal bore 238 of the bearing mandrel 236.

The working fluid WF can continue through longitudinal bore 238 of the bearing mandrel 236 to the BHA/drill motor 8 or any other tool downstream therefrom.

Continued flow of the working fluid WF continues to rotate the rotor 150 and thus the valve mandrel 180 and oscillating valve head 210 to the closed position.

It can be appreciated that a small amount of working fluid WF may travel through the stationary valve central bore 204 of the stationary valve head 20 and past the oscillating valve head 210 and/or the central section 186 of the valve mandrel 180, however the fluid pressure may not be sufficient to force the working fluid through the tight tolerances therebetween. It can further be appreciated that a small amount of working fluid WF may travel through the channels 218, 218' and past the oscillating valve head 210, however, this small amount of working fluid may not have operational impact on the power unit 142.

FIG. 25 shows the stationary and oscillating valve heads 200, 210 in the fully closed position, where the oscillating valve bore 216 is not in communication with the stationary valve bore 204. In this closed position, a flow of the working fluid WF is primarily stopped from entering the oscillating valve bore 216 for a brief period of time. It can be appreciated that the speed of rotation and/or ceasing operation of the rotor 150 can be controlled by the flow of the working fluid WF pumped down the drill string 2 or the flow entering the power unit 142.

Rotation of the rotor 150 by the flow of the working fluid WF creates the cyclic obstruction of the stationary valve bore 204 and/or the oscillating valve bore 216, and can lead to the fluctuating TFA, which in turn can create agitation of the BHA/drill motor 8. This agitation can then assist in advancing the drill string 2 and/or the BHA/drill motor 8 up or down the wellbore 6. Further, this agitation can assist in breaking up any obstructions located ahead of the BHA/drill motor 8. Still further, this agitation can assist in the removal of debris upwards past the drill motor assembly, and/or removal of the drill string 2 and any tool attached thereto up the wellbore 6.

The valve unit 170 is a design that will allow for pulsations within a downhole drilling motor using the general principles laid out by Joukowski's water hammer theories. The general concept of the valve unit 170 can be a modular component to the drilling motors, such as but not limited to the Talon Wellbore motors. The valve unit 170 can be designed to be added, removed or interchanged from a build based on customer request. The benefit of this is to have the option of modifying a motor that has gone into the field based upon varying conditions downhole.

The valve unit 170 can also be designed to open fast, and close slowly. This minimizes the water hammer potential while increasing the surge pulsation. A benefit of this is to pull the motor uphole, limiting the possibility of producing too high of weight on the dill bit and stalling the motor.

The valve unit 170 can be further designed to be put in the middle of the drilling motor so that the distance from the bearing pack to the drill bit is low. This is a benefit as forces seen by the drill bit do not produce a high bending moment and introduce high bending force onto the mandrel.

One advantage of the valve unit 170 can be that the pulsations see no bypass, ensuring the drilling motor sees constant and predictable pulsations.

The stationary and oscillating valve heads 200, 210 are a reliable system that uses the rotation of the power section or the power unit 142 to produce the pulsations. The benefit of this is that the systems of rotation are already in place, not requiring much additional length to the tool.

According to one aspect, the present technology can include a pulsation valve system for providing oscillating fluid flow to a downhole tool. The pulsation valve system can include a valve mandrel 180, an oscillating valve head 210 and a stationary valve head 200. The valve mandrel 180 can be operably associated with a rotor 150 of a drilling motor assembly for rotation by the rotor 150. The valve mandrel 180 can include a valve mandrel cavity 188 defined through a first mandrel end 182 and into the valve mandrel 180 along a longitudinal axis of the valve mandrel 180. The valve mandrel 180 can include a plurality of lateral bores 190 defined at an angle through the valve mandrel 180 and in communication with the valve mandrel cavity 188. The oscillating valve head 210 can be attachable to the valve mandrel 180 and rotatable with the valve mandrel 180. The oscillating valve head 210 can include an oscillating valve bore 216 defined therethrough and parallel with a longitudinal axis of the oscillating valve head 210. The oscillating valve head 210 can be attached on the valve mandrel so that the oscillating valve head 210 rotates with the valve mandrel. The stationary valve head 200 can be positioned adjacent and stationary with respect to the oscillating valve head 210. The stationary valve head 200 can include a stationary valve bore 204 defined therethrough and parallel with a longitudinal axis of the stationary valve head 200. The oscillating valve bore 216 can be cyclically alignable with the stationary valve bore 204 at a predetermined rotational position based on rotation of the rotor 150 so that the fluid flow cyclically passes through the stationary valve bore 204 and the oscillating valve bore 216.

According to another aspect, the present technology can include a modular pulsation valve system for providing oscillating fluid flow to a downhole tool. The pulsation valve system can include a valve unit 170 connectable between a power unit 142 and a bearing unit 230 of a drilling motor assembly. The valve unit 170 can include a valve mandrel 180, an oscillating valve head 210 and a stationary valve head 200. The valve mandrel 180 can be operably associated with a rotor 150 of the drilling motor assembly for rotation by the rotor 150. The valve mandrel 180 can include a mandrel cavity 188 defined through a first mandrel end 182 and into the valve mandrel 180 along a longitudinal axis of the valve mandrel 180. The valve mandrel 180 further can include a plurality of lateral bores 190 defined at an angle through the valve mandrel 180 and in communication with the mandrel cavity 188. The oscillating valve head 210 can be attachable to the valve mandrel 180 and rotatable with the valve mandrel 180. The oscillating valve head 210 can include an oscillating valve bore 216 defined therethrough and parallel with a longitudinal axis of the oscillating valve head 210. The oscillating valve head 210 can be attached on the valve mandrel 180 so that the oscillating valve head 210 rotates with the valve mandrel 180. The stationary valve head 200 can be positioned adjacent and stationary with respect to the oscillating valve head 210. The stationary valve head 200 can include a stationary valve bore 204 defined therethrough and parallel with a longitudinal axis of the stationary valve head 200. The oscillating valve bore 216 can be cyclically alignable with the stationary valve bore 204 at a predetermined rotational position based on rotation of the rotor 150 so that the fluid flow cyclically passes through the stationary valve bore 204 and the oscillating valve bore 216.

According to yet another aspect, the present technology can include a pulsation valve system including a power unit 142 of a drilling motor assembly, a bearing unit 230 of the drilling motor assembly, and a valve unit 170 attachable therebetween. The power unit 142 can include a rotor 150 configured to rotate upon receiving a fluid flow WF. The valve unit 170 can include a valve housing 172, a valve mandrel 180, an oscillating valve head 210 and a stationary valve head 200. The valve housing 172 can define a valve housing bore 174 therethrough. The valve mandrel 180 can be rotatably receivable in the valve housing bore 174. The valve mandrel 180 can be operably associated to the rotor 150. The valve mandrel 180 can include a central section 186 and a shaft section 196. The central section 186 can have a size greater than the shaft section 196 thereby creating a stop ledge 194. A mandrel cavity 188 can be defined in the central section 186 along a longitudinal axis of the valve mandrel 180, and a plurality of lateral bores 190 can be defined at an angle through the central section 188 and in communication with the mandrel cavity 188. The oscillating valve head 210 can be attachable to the shaft section 196 adjacent the stop ledge 194 and rotatable within the valve housing bore 174. The oscillating valve head 210 can be attached to the valve mandrel 180 so that the oscillating valve head 210 rotates with the valve mandrel 180. The oscillating valve head 210 can include an oscillating valve bore 216 defined therethrough and parallel with a longitudinal axis of the oscillating valve head 210. The stationary valve head 200 can be attachable to the valve housing 172 in the valve housing bore 174. The stationary valve head 200 can be positioned adjacent and stationary with respect to the oscillating valve head 210. The stationary valve head 200 can include a stationary valve bore 204 defined therethrough and parallel with a longitudinal axis of the stationary valve head 200. The oscillating valve bore 216 can be cyclically alignable with the stationary valve bore 204 at a predetermined rotational position based on rotation of the rotor 150 so that the fluid flow WF cyclically passes through the stationary valve bore 204 and the oscillating valve bore 216.

According to still yet another aspect, the present technology can include a method of using a pulsation valve system for providing oscillating fluid flow to a downhole tool. The method can include flowing a working fluid WF through a power unit 142 of a drilling motor assembly to rotate a rotor 150. Flowing the working fluid WF from the power unit 142 to a stationary valve bore 204 defined through a stationary valve head 200 fixedly secured inside a valve assembly housing 172. Rotating a valve mandrel 180 by way of rotation of the rotor 150 so that an oscillating valve bore 216 defined through an oscillating valve head 210 comes in and out of alignment with the stationary valve bore 204. The valve mandrel 180 can be operatively coupled to the rotor 150. Controlling the flow of the working fluid WF exiting the oscillating valve bore 216 dependent on a rotational location of the oscillating valve bore 216 in relation to the stationary valve bore 204.

In some or all embodiments, an amount of the fluid flow WF entering the stationary valve bore 204 can be dependent on a rotational location of the oscillating valve bore 216 in relation with the stationary valve bore 204.

In some or all embodiments, the stationary valve bore 204 can have a size greater than the oscillating valve bore 216.

In some or all embodiments, the stationary valve bore 204 can have a radial length greater than a width of the oscillating valve bore 216.

In some or all embodiments, the stationary valve bore 204 can be offset from a stationary valve central bore 202 defined through the stationary valve head 200. The stationary valve bore 204 is not in communication with the stationary valve central bore 202.

In some or all embodiments, the stationary valve head 200 can be fixedly secured in a first section of a valve housing bore 174 of a valve assembly housing 172. The first section of the valve housing bore 174 can be configured to rotatably receive the oscillating valve head 210 and at least a portion of the valve mandrel 180.

Some or all embodiments of the present technology can include a bushing 262 located in the stationary valve central bore 202, The bushing 262 can be configured to rotatably and axially receive a shaft section 196 of the valve mandrel 180.

In some or all embodiments, the shaft section of the valve mandrel 180 can be receivable and secured in an oscillating valve central bore 212 defined in the oscillating valve head 210.

In some or all embodiments, the oscillating valve central bore 212 can feature an outwardly tapering section 214 having an entry opening with a size greater than a size of the oscillating valve central bore 212.

Some or all embodiments of the present technology can include a ring wedge 224 slidably receivable along the shaft section 196 and configured to be received in the tapering section 214 of the oscillating valve central bore 212.

In some or all embodiments, the valve mandrel 180 can include a central section 186 having a size greater than a size of the shaft section 196 to create a stop ledge 194. The ring wedge 224 can be configured to abut the stop ledge 194 when the oscillating valve head 210 is attached to the shaft section 196.

In some or all embodiments, the valve mandrel 180 can include a transitional section 192 between the central section 186 and the shaft section 196. An exit opening of the lateral bores 190 can be defined in the transitional section 192, and wherein the stop ledge 194 can be between the transitional section 192 and the shaft section 196.

In some or all embodiments, the stationary valve head 200 can be secured to the valve assembly housing 172 between the oscillating valve head 210 and a valve housing stop ledge 175.

In some or all embodiments, the valve housing bore 174 of the valve assembly housing 172 can define a first section having a size greater than a second section thereby creating the valve housing stop ledge 175.

In some or all embodiments, the oscillating valve head 210 can include channels 218 radially defined in an oscillating valve face of the oscillating valve head 210 adjacent to a stationary valve face of the stationary valve head 200. The channels 218 can be configured to allow fluid WF to travel between the stationary valve head 200 and the oscillating valve head 210 to an open area between an internal area of the bushing 222 and an external surface of a shaft section 196 of the valve mandrel 180.

In some or all embodiments, the oscillating valve head 210 can include external channels 218' defined in an external side of the oscillating valve head 210 that face an internal surface of the valve assembly housing 172 that defines the first section of the valve housing bore 174. The external channels 218' can be configured to allow fluid WF to travel between an open area between internal surface of the valve assembly housing 172 and the external side of the oscillating valve head 210.

Some or all embodiments of the present technology can include a flexshaft 156 connected to a second connection end 198 of the valve mandrel 180. The flexshaft 156 can be operably connected to the rotor 150 of the drilling motor assembly.

In some or all embodiments, the pulsation valve system can be a modular valve unit 170 configured to be connected between a power unit 142 and a bearing unit 230 of the drilling motor assembly.

In some or all embodiments, the power unit 142 can include or stator/rotor motor assembly 148, 150 and a flexshaft 156.

In some or all embodiments, the oscillating valve head 210 and/or the stationary valve head 200 can be configured to produce a predetermined number of cyclic obstructions of flow WF to the downhole tool.

In some or all embodiments, the oscillating valve bore 216 and/or the stationary valve bore 204 can be configured to produce a predetermined flow rate and/or volumetric flow rate.

In some or all embodiments, the stationary valve bore 204 can be a plurality of stationary valve bores 204 radially arrange about a stationary valve central bore 202.

In some or all embodiments, the oscillating valve bore 216 can be a plurality of oscillating valve bores 216 radially arrange about an oscillating valve central bore 212.

In some or all embodiments, a first mandrel end 182 of the valve mandrel 180 can be attachable to a connection end of a bearing mandrel 236 of a bearing unit 230 of the drilling motor assembly.

In some or all embodiments, a second end 198 of the valve mandrel 180 can be attachable to a first connection end of a flexshaft 156, and a second connection end of the flexshaft 156 can be attachable to the rotor 150.

While embodiments of the downhole pulsation valve system and method have been described in detail, it should be apparent that modifications and variations thereto are possible, all of which fall within the true spirit and scope of the present technology. With respect to the above description then, it is to be realized that the optimum dimensional relationships for the parts of the present technology, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present technology. For example, any suitable sturdy material may be used instead of the above-described. And although providing oscillating fluid flow to a pulsation and/or agitation device for reducing friction acting on a tool string and/or advancing the tool string have been described, it should be appreciated that the downhole pulsation valve system and method herein described is also suitable for providing a valve assembly for providing oscillating fluid flow to a tool or assembly downstream thereof.

Therefore, the foregoing is considered as illustrative only of the principles of the present technology. Further, since numerous modifications and changes will readily occur to those skilled in the art, it is not desired to limit the present technology to the exact construction and operation shown and described, and accordingly, all suitable modifications and equivalents may be resorted to, falling within the scope of the present technology.

What is claimed as being new and desired to be protected by Letters Patent of the United States is as follows:

1. A pulsation valve system for providing oscillating fluid flow to a downhole tool, the pulsation valve system comprising:

a valve mandrel including a shaft section, and a mandrel cavity defined through a first mandrel end and into the valve mandrel along a longitudinal axis of the valve mandrel;

an oscillating valve head including an oscillating valve bore defined therethrough and parallel with a longitudinal axis of the oscillating valve head, the oscillating valve head being attachable to the shaft section of the valve mandrel so that the oscillating valve head rotates with the valve mandrel;

a stationary valve head positioned adjacent and stationary with respect to the oscillating valve head, the stationary valve head including a stationary valve central bore and a stationary valve bore each being defined therethrough and parallel with a longitudinal axis of the stationary valve head;

wherein the shaft section of the valve mandrel is receivable through the stationary valve central bore and secured in the oscillating valve central bore defined in the oscillating valve head;

wherein the oscillating valve bore being cyclically allignable with the stationary valve bore at a predetermined rotational position based on rotation of a rotor so that the fluid flow cyclically passes through the stationary valve bore and the oscillating valve bore.

2. The pulsation valve system according to claim 1, wherein an amount of the fluid flow entering the oscillating valve bore is dependent on a rotational location of the oscillating valve bore in relation with the stationary valve bore.

3. The pulsation valve system according to claim 2, wherein the stationary valve bore has a size greater than the oscillating valve bore.

4. The pulsation valve system according to claim 2, wherein the stationary valve bore has a radial length greater than a width of the oscillating valve bore.

5. The pulsation valve system according to claim 2, wherein the stationary valve bore is offset from the stationary valve central bore defined through the stationary valve head, and wherein the stationary valve bore is not in communication with the stationary valve central bore.

6. The pulsation valve system according to claim 5, wherein the stationary valve head is fixedly secured in a first section of a valve housing bore of a valve assembly housing, the first section of the valve housing bore being configured to rotatably receive the oscillating valve head and at least a portion of the valve mandrel.

7. The pulsation valve system according to claim 6 further comprising a bushing located in the stationary valve central bore, the bushing being configured to rotatably and axially receive a valve end section of the mandrel.

8. The pulsation valve system according to claim 7, wherein the oscillating valve head includes channels radially defined in an oscillating valve face of the oscillating valve head adjacent to a stationary valve face of the stationary valve head, and wherein the channels are configured to allow fluid to travel between the stationary valve head and the oscillating valve head to an open area between an internal area of the bushing and an external surface of the shaft section of the valve mandrel.

9. The pulsation valve system according to claim 1, wherein the valve mandrel includes a plurality of lateral bores defined through the valve mandrel and in communication with the mandrel cavity.

10. The pulsation valve system according to claim 1, wherein the oscillating valve central bore includes a tapering section having an entry opening with a size greater than a size of the oscillating valve central bore.

11. The pulsation valve system according to claim 10 further comprising a ring wedge slidably receivable along the shaft section and configured to be received in the tapering section of the oscillating valve central bore.

12. The pulsation valve system according to claim 11, wherein the valve mandrel includes a central section having a size greater than a size of the shaft section to create a stop ledge, and wherein the ring wedge is configured to abut the stop ledge when the oscillating valve head is attached to the shaft section.

13. The pulsation valve system according to claim 12, wherein the valve mandrel includes a transitional section between the central section and the shaft section, wherein an exit opening of the lateral bores are defined in the transitional section, and wherein the stop ledge being between the transitional section and the shaft section.

14. The pulsation valve system according to claim 12, wherein the stationary valve head is secured to the valve assembly housing between the oscillating valve head and a valve housing stop ledge.

15. The pulsation valve system according to claim 14, wherein the first section of the valve housing bore having a size greater than a second section of the valve housing bore thereby creating the valve housing stop ledge.

16. The pulsation valve system according to claim 1, wherein the oscillating valve head includes external channels defined in an external side of the oscillating valve head that face an internal surface of a valve assembly housing that defines a first section of a valve housing bore, and wherein the external channels are configured to allow fluid to travel between an open area between the internal surface of the valve assembly housing and the external side of the oscillating valve head.

17. The pulsation valve system according to claim 1 further comprising a flexshaft connected to a second end section of the valve mandrel, wherein the flexshaft is operably connected to the rotor of a drilling motor assembly.

18. The pulsation valve system according to claim 1, wherein the pulsation valve system is a modular unit configured to be connected between a power unit and a bearing unit of a drilling motor assembly.

19. A pulsation valve system comprising:

a power unit of a drilling motor assembly, the power unit including a rotor configured to rotate upon receiving a fluid flow;

a bearing unit of the drilling motor assembly; and a valve unit attachable between the power unit and the bearing unit, the valve unit comprising:

a valve housing defining a valve housing bore therethrough;

a valve mandrel rotatably receivable in the valve housing bore, the valve mandrel being operably associated to the rotor, the valve mandrel including a central section and a shaft section, the central section having a size greater than the shaft section thereby creating a stop ledge, a mandrel cavity defined in the central section along a longitudinal axis of the valve mandrel, and a plurality of lateral bores defined through the central section and in communication with the mandrel cavity;

an oscillating valve head attachable to the shaft section adjacent the stop ledge and rotatable within the valve housing bore, the oscillating valve head being attachable to the valve mandrel so that the oscillating valve head rotates with the valve mandrel, the oscillating valve head including comprising:

an oscillating valve bore defined therethrough and parallel with a longitudinal axis of the oscillating valve head; and channels radially defined in an oscillating valve face of the oscillating valve head adjacent to a stationary valve face of the stationary valve head, the channels being configured to allow fluid to travel between the stationary valve head and the oscillating valve head; and a stationary valve head attachable to the valve housing in the valve housing bore, the stationary valve head being positioned adjacent and stationary with respect to the oscillating valve head, the stationary valve head including a stationary valve bore defined therethrough and parallel with a longitudinal axis of the stationary valve head;

wherein the oscillating valve bore being cyclically allignable with the stationary valve bore at a predetermined rotational position based on rotation of the rotor so that the fluid flow cyclically passes through the stationary valve bore and the oscillating valve bore.

20. A method of using a pulsation valve system for providing oscillating fluid flow to a downhole tool, the method comprising the steps of:

a) flowing a working fluid through a power unit of a drilling motor assembly to rotate a rotor;

b) rotating a valve mandrel by way of rotation of the rotor so that an oscillating valve bore defined through an oscillating valve head cyclically aligns with a stationary valve bore defined through a stationary valve head at a predetermined rotational position based on rotation of the rotor so that fluid flow cyclically passes through the stationary valve bore and the oscillating valve bore, the valve mandrel being operatively coupled to the rotor, and wherein a shaft section of the valve mandrel is receivable through a stationary valve central bore defined through the stationary valve head and secured in an oscillating valve central bore defined in the oscillating valve head; and c) controlling flow of the working fluid exiting the oscillating valve bore dependent on a rotational location of the oscillating valve bore in relation to the stationary valve bore; wherein the valve mandrel includes a mandrel cavity defined through a first mandrel end and into the valve mandrel along a longitudinal axis of the valve mandrel;

wherein the oscillating valve bore being parallel with a longitudinal axis of the oscillating valve head; and wherein the stationary valve head being positioned adjacent and stationary with respect to the oscillating valve head, and wherein the stationary valve central bore and the stationary valve bore each being parallel with a longitudinal axis of the stationary valve head.

* * * * *